US006838610B2

(12) United States Patent
de Moraes

(10) Patent No.: US 6,838,610 B2
(45) Date of Patent: Jan. 4, 2005

(54) ARRANGEMENT OF A RHYTHMIC APPARATUS WITH A VEHICLE SOUND APPARATUS, RHYTHMIC ACCOMPANIMENT METHOD AND ELECTRONIC TRANSDUCER

(75) Inventor: Aurélia Rótolo de Moraes, Curitiba (BR)

(73) Assignee: AGM - Academia de Ginastica Movel Ltda., Curitiba (BR)

( * ) Notice: Subject to any disclaimer, the term of this patent is extended or adjusted under 35 U.S.C. 154(b) by 0 days.

(21) Appl. No.: 10/265,301

(22) Filed: Oct. 4, 2002

(65) Prior Publication Data

US 2003/0079600 A1 May 1, 2003

Related U.S. Application Data

(63) Continuation of application No. PCT/BR01/00041, filed on Apr. 6, 2001.

(30) Foreign Application Priority Data

Apr. 6, 2000 (BR) ..... 0001078
Mar. 4, 2001 (BR) ..... 0117016

(51) Int. Cl.[7] ..... G10H 3/14
(52) U.S. Cl. ..... 84/730
(58) Field of Search ..... 84/723, 730

(56) References Cited

U.S. PATENT DOCUMENTS

| | | | | |
|---|---|---|---|---|
| 3,865,001 A | | 2/1975 | Hershey | |
| 4,359,714 A | * | 11/1982 | Tsunoda et al. | 340/460 |
| 4,867,028 A | | 9/1989 | Jones | |
| 4,995,294 A | * | 2/1991 | Kashio et al. | 84/738 |
| 5,062,341 A | * | 11/1991 | Reiling et al. | 84/702 |
| 5,223,655 A | * | 6/1993 | Watanabe et al. | 84/637 |
| 5,227,574 A | * | 7/1993 | Mukaino | 84/652 |
| 5,557,683 A | * | 9/1996 | Eubanks | 381/86 |
| 5,856,628 A | | 1/1999 | Noguchi et al. | |
| 6,386,039 B1 | * | 5/2002 | Peters | 73/589 |

FOREIGN PATENT DOCUMENTS

| | | |
|---|---|---|
| GB | 2 173 031 A | 10/1986 |
| GB | 2 183 076 A | 5/1987 |

* cited by examiner

*Primary Examiner*—Jeffrey Donels
(74) *Attorney, Agent, or Firm*—Alston & Bird LLP

(57) ABSTRACT

The present invention relates to an arrangement of a rhythmic apparatus with a vehicle sound apparatus that generates a first audio signal. The arrangement comprises an electronic module and an electronic transducer. The electronic transducer comprises conversion means of vibratory pulses into electrical signals. The electronic module comprises a processing unit having reception means for the signals from the electronic transducer and conversion means for converting the signals into a second audio signal. The processing unit is associated with a mixer unit having means for combining the second audio signal with the first audio signal.

7 Claims, 25 Drawing Sheets

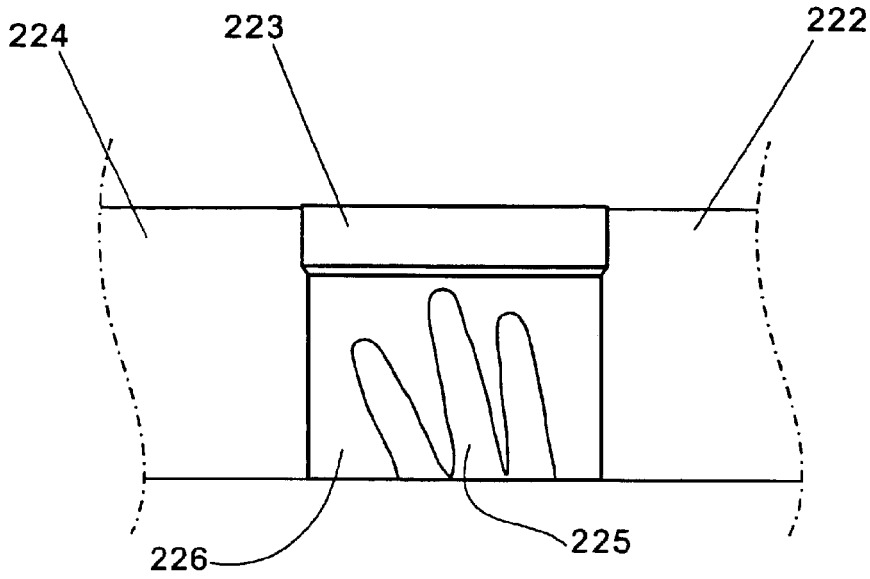
FIGURE 19
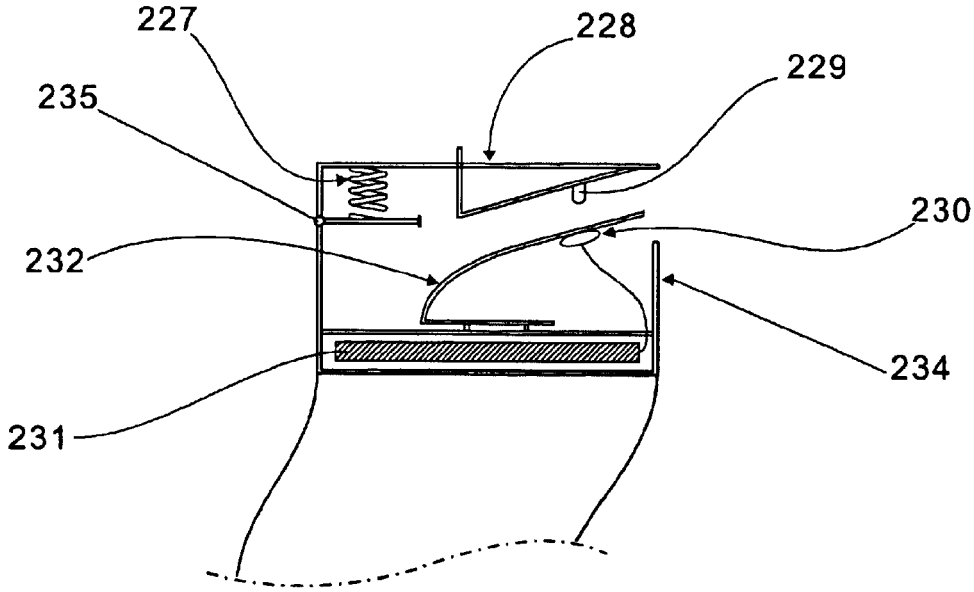
FIGURE 19-A

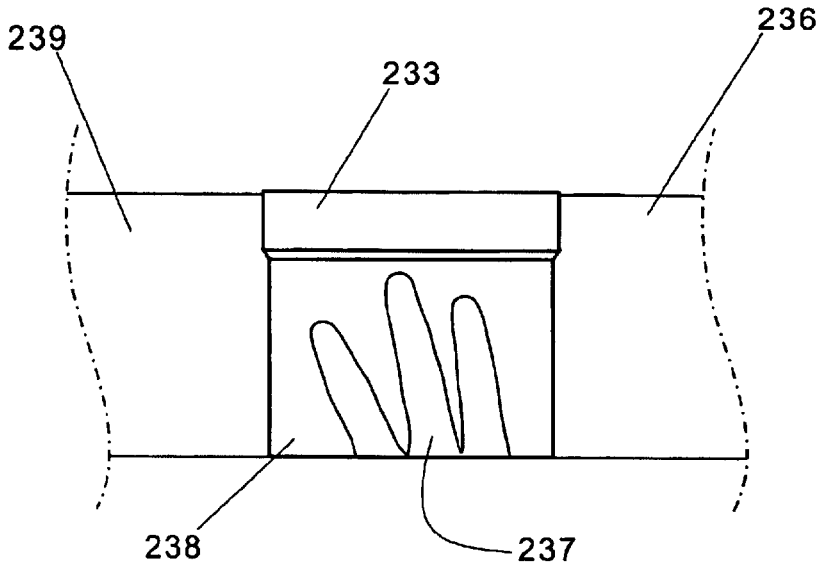
FIGURE 20
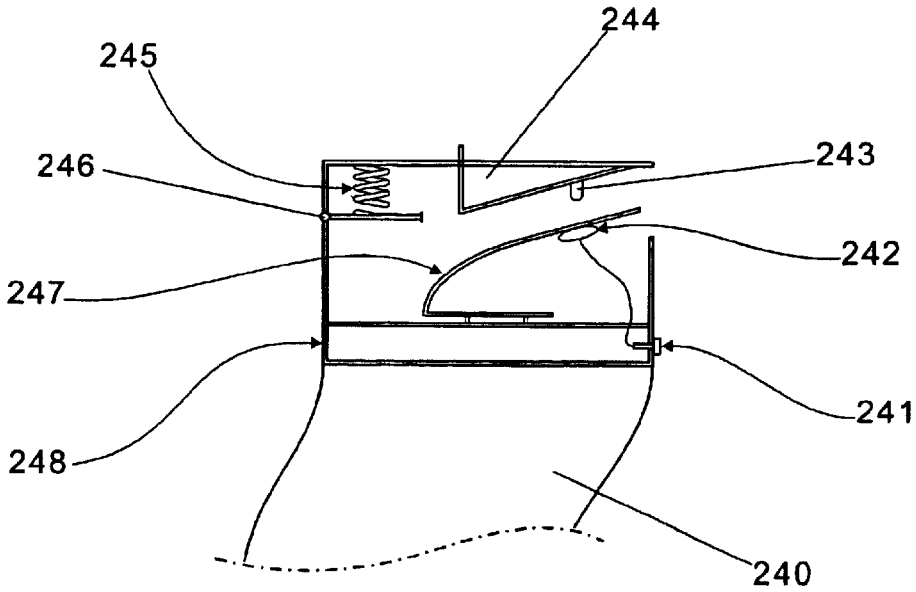
FIGURE 20-A

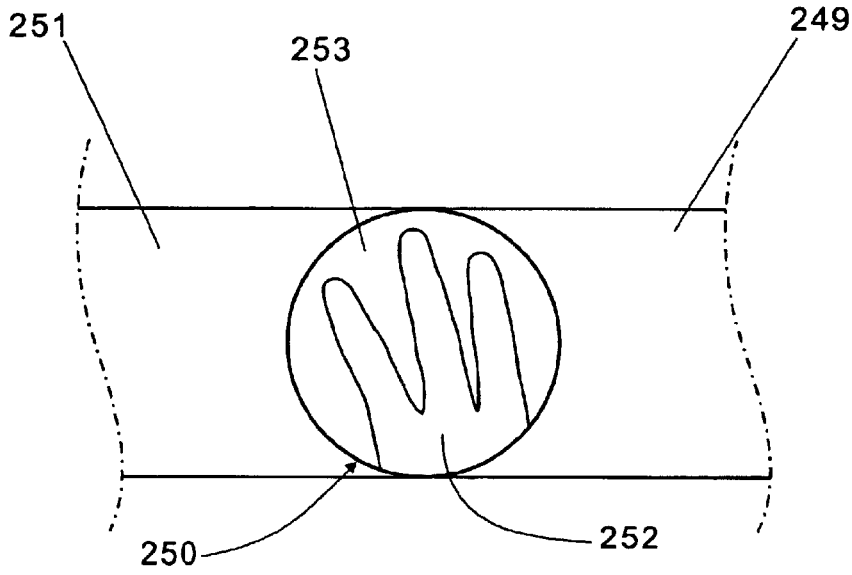
FIGURE 21
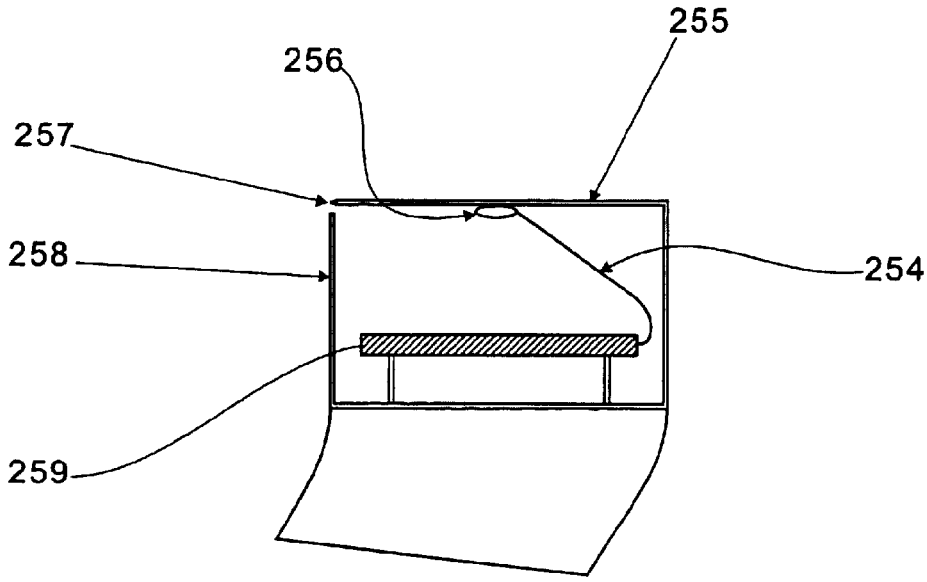
FIGURE 21-A

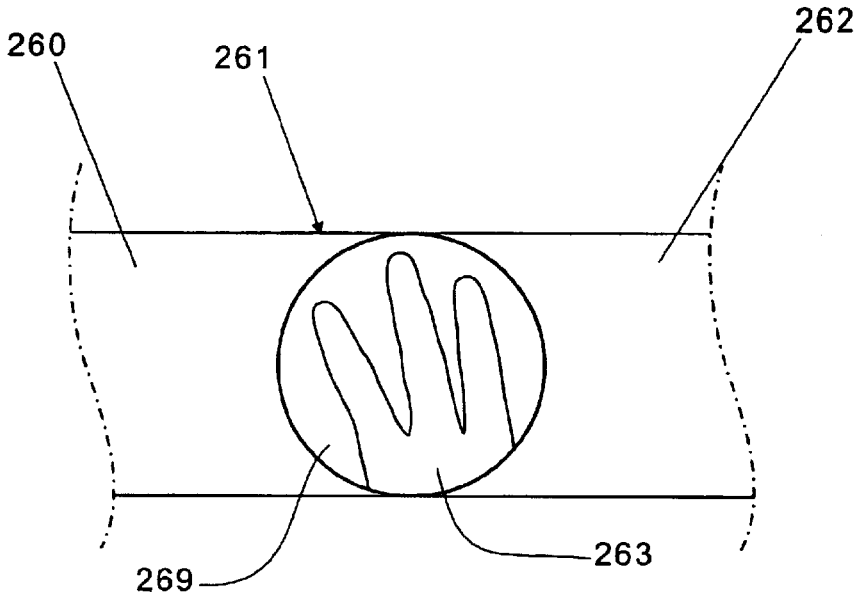
FIGURE 22
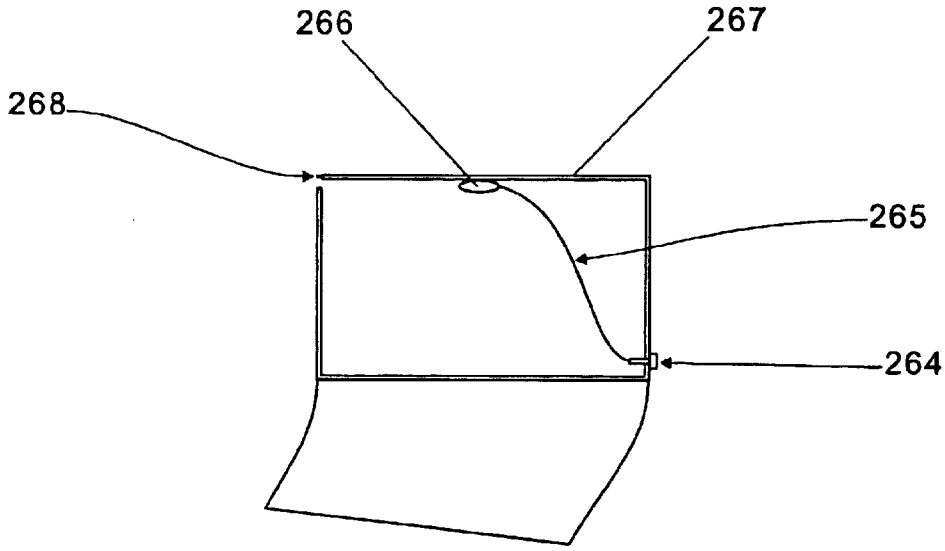
FIGURE 22-A

ARRANGEMENT OF A RHYTHMIC APPARATUS WITH A VEHICLE SOUND APPARATUS, RHYTHMIC ACCOMPANIMENT METHOD AND ELECTRONIC TRANSDUCER

CROSS-REFERENCE TO RELATED APPLICATIONS

This application is a Continuation of International Application PCT/BR01/00041 filed on Apr. 6, 2001, which designated the U.S. and was published under PCT Article 21(2) in English, and which is hereby incorporated herein in its entirety by reference.

BACKGROUND OF THE INVENTION

1. Field of the Invention

This invention is directed to an arrangement of a rhythmic apparatus with a vehicle sound apparatus, particularly used in the production of sound effects and able to substantially reduce or even eliminate the stress of individuals, mainly when they are inside automotive vehicles for long periods. This invention is directed to a rhythmic accompaniment method through the utilization of an electronic transducer, which composes the apparatus. The technical sector to which this invention is directed is that of electronics applied to psychology.

The Patent Application PI 0001078-2 of 04.06.2000 and the Addition Certificates, C1 0001078-2 of 10.27.2000 and C2 0001078-2 of 12.08.2000 of the same applicant to which priority is hereby claimed, describe a rhythmic apparatus and respective method.

2. Description of the State of the Art

Existing known means to combat stress are based on the intake of natural or allopathic medicine and other non natural means which the individual develops through other addictions, such as the excessive consumption of cigarettes, alcohol or drugs, or even the unnecessary intake of colas, candies and sugars in general, in order to aid in healing the anxiety produced by stress.

Another form of combating stress is the practice of physical exercise. However, it is not always possible to practice physical exercise, because physical exercise demands an appropriate place for practice.

Studies on stress show it's importance, where it is observed that stress reaches thousands of people and is now one of the greatest causes for low quality of life. Contemporary society faces very serious problems, by virtue of stresses, from pressures we suffer daily, from fear we feel, and finally from difficulties we try to overcome and, which most of times, we cannot.

These problems will result in what we call stress or yet stress syndrome. Stress is a physiologic reaction, which occurs when we need to face a situation which irritates us, scares us, excites us, wears us out, confounds us, or even makes us immensely happy. The answer to so much stress is that the changes suffered by our society were faster than the evolution of the human body itself. Never were the expectations and stresses so great. We will see the damage stress causes in traffic.

It is known that stress interferes in every person in different ways. We can mention some stress symptoms, as for example discouragement, lack of motivation, sleep disturbances, low self-esteem, mental tiredness, depression, lack of vitality, and, chiefly, anxiety. Stress occurs as a result of this anxiety, which, as we have seen, causes serious damage to organisms. One great stress generator is the social factor, which generates traffic in large cities. It is also within traffic that the feared "Panic Syndrome in Jammed Traffic" occurs, in which the person experiences incontrollable situations.

The vehicle is an instrument of work, hobby, etc; it gives status, but it is one of the places where a person is submitted to several pressures which will lead him/her to have the symptoms described above.

When we enter a vehicle, oftentimes, we have to wait, sitting in a driver or passenger seat, not able to get up to walk for a while, not able to park the car and get out, not able to do our basic necessities, not able to use the restroom, not able to breathe pure air because, most of the time, we are in a place with thousands of other vehicles with their motors on, which pollute the air in the vicinity of the vehicle. Sometimes, we are late and then we start to be stressed. In addition to the sum of problems we already have before entering the vehicle, and which are brooding in our minds, by the time we are inside a car, a traffic jam will cause even more stress. Sometimes, we have to bear the presence of other passengers who may not share our ideas and who may cause additional stress.

Consider an analogy of a stressed person in another situation, for instance at home, and what that stressed person does to dissipate the stress. We go to the kitchen to eat something, we go to the toilet, we walk in the yard, we take a shower/bath, we go to a son's bedroom to chat, we lay down on a sofa or bed to rest, we go to the living room to watch TV, to hear a song, to play with the dog, to talk to a spouse or significant relation, etc.

Then we can see that we consider vehicles to be an extension of our home, a symbol of status, a means which takes us to new routes, a work tool or a freedom sensation, but that in vehicles we do not have the means as we do in our homes that we need to dissipate the stress. By using the method and rhythmic apparatus of the present invention, we can significantly reduce the stress level, and we can even eliminate it in many cases, inside automotive vehicles.

Also some persons in automotive vehicles do not stress but are hyperactive with excessive energy (mainly young people or children). Then, for those people who have the natural need to keep moving in order to dissipate this excessive energy, we also recommend the use of the present invention.

In current literature, we can find work and scientific research aimed at minimizing stressing agents and, thus, reducing stress effects on people. These sources generally address self-help, reflection, interpersonal relations, aromatherapy, chromo therapy, psychotherapy, vacations, hobbies, massages, vibration medicine, floral therapy, exercise, relaxing, nutrition, bio-molecular medicine, acupuncture, sex, yoga, neuron-linguistic programming, medicines, etc. However, such options are directed to general situations and are not specific, as it is the case of social contingency stress, vehicle traffic, one of the greatest disturbances of the modern society faced daily by thousands of people.

Unfortunately, the trend is that traffic is worsening continuously, at alarming proportions. Statistical research presents stress as responsible for a major part of accidents that occur in cities and roads around the world (directly or indirectly).

The stress caused by great traffic jams in roads and cities trends to reduce the good humour of any person. The consequences are severe and the number of automobile accidents continues to increase, as well as traffic quarrels between stressed drivers that often result in serious bodily injury. Health has never preoccupied us as much it does today.

BRIEF SUMMARY OF THE INVENTION

One objective of this invention is to provide an arrangement of a rhythmic apparatus with a vehicle sound apparatus able to noticeably reduce or even eliminate the stress level in persons confined, for long periods, in automotive vehicles.

Another objective of this invention is to provide an arrangement of a rhythmic apparatus with a vehicle sound apparatus, which allows for the dissipation of excess energy in hyperactive people when they are inside automotive vehicles.

It is still another objective of this invention to provide a rhythmic accompaniment method through use of the rhythmic apparatus described herein.

This invention uses the technical-scientific precepts described in the literary work "Academia de Ginástica Móvel—AGM" (Movable Gym Academy), the author of which is the inventor of Method and Apparatus, Aurélio Rótolo de Moraes, registered on Dec. 11, 1997 in the Register of Titles Documents and Legal Entity under no. 12.107, in the city of Araucária, State of Paraná, from Culture Ministry, in the Authorial Rights office, Record or Registering Certificate no. 153.191, of the book 251, leaf 296, in the city of Rio de Janeiro, State of Rio de Janeiro.

The scientific precepts described in the above mentioned literary work were evaluated, tested and approved, after 18 months of research, by a technical staff, headed by Dr. Rosangela Terezinha Cristani Arruda, Psychologist, inscribed in the Psychology Regional Board under no. 08/2170 in the State of Paraná, the technical-scientific report being registered in the Register of Titles Documents and Legal Entity under no. 13.479 in Feb. 28, 2000, in the city of Araucária, State of Paraná.

The literary work of this inventor, "Academia de Gin ástica Móvel—AGM," encouraged this Patent Application ; "Academia de Ginástica Móvel—AGM" (which was not distributed) means physical and mental exercises within a movable compartment, as, for example, automotive vehicles. Why? Because the accumulated stress inside an automotive vehicle is not easily dissipated and, sometimes, is so much that the vehicle with its occupants is compared to a pressure pot about to blow up.

This invention is directed to an arrangement of a rhythmic apparatus with a vehicle sound apparatus, the vehicle sound apparatus generating a first audio signal, the arrangement comprising an electronic module and an electronic transducer, the electronic transducer comprising a means of vibratory pulses converted into electrical signals, the electronic module comprising a processing unit having a reception means for the signals from the electronic transducer and a conversion means for these signals into a second audio signal, the processing unit being associated with a mixer unit having a means to join the second audio signal to the first audio signal.

This invention is further directed to a rhythmic accompaniment method comprising the steps of choosing the first audio signal in the sound apparatus, choosing a sound timbre from some percussion musical instrument for the second audio signal in the electronic module, emitting the second audio signal through excitation of the electronic transducer and following the first audio signal through the rhythm of the second audio signal.

BRIEF DESCRIPTION OF THE SEVERAL VIEWS OF THE DRAWING(S)

This invention will be hereinafter described in more detail based on the embodiment represented in the drawings.

FIG. 19 is a schematic view of a ninth embodiment of the electronic transducer illustrated in FIG. 3;

FIG. 19A is a schematic sectional view of the ninth embodiment of the electronic transducer illustrated in FIG. 3;

FIG. 20 is a schematic view of a tenth embodiment of the electronic transducer illustrated in FIG. 3;

FIG. 20A is a schematic sectional view of the tenth embodiment of the electronic transducer illustrated in FIG. 20;

FIG. 21 is a schematic view of a eleventh embodiment of the electronic transducer illustrated in FIG. 3;

FIG. 21A is a schematic sectional view of the eleventh embodiment of the electronic transducer illustrated in FIG. 21;

FIG. 22 is a schematic view of a twelfth embodiment of the electronic transducer illustrated in FIG. 3;

FIG. 22A is a schematic sectional view of the twelfth embodiment of the electronic transducer illustrated in FIG. 21;

DETAILED DESCRIPTION OF THE INVENTION

The rhythmic apparatus is based on the mixture of three basic principles: the song, the rhythm and the movement.

A song is an expression means practiced by every person, and the therapeutic value of a song is explored and spread more and more every day, including producing a great benefit to a person's mind causing a psychic, physical and social welfare sensation. Relaxing exercises are rarely carried out without the sound of a song. A song stimulates the functioning of several cerebral regions, areas responsible for emotion, memory and motor control.

Rhythm, one of the song elements, has an extreme importance since it is possible for us to discharge stress and release ourselves from daily afflictions through rhythmic repetition.

The movement, in conjunction with the song and the rhythm, is the fundamental base of the present apparatus and method.

Figure 14:
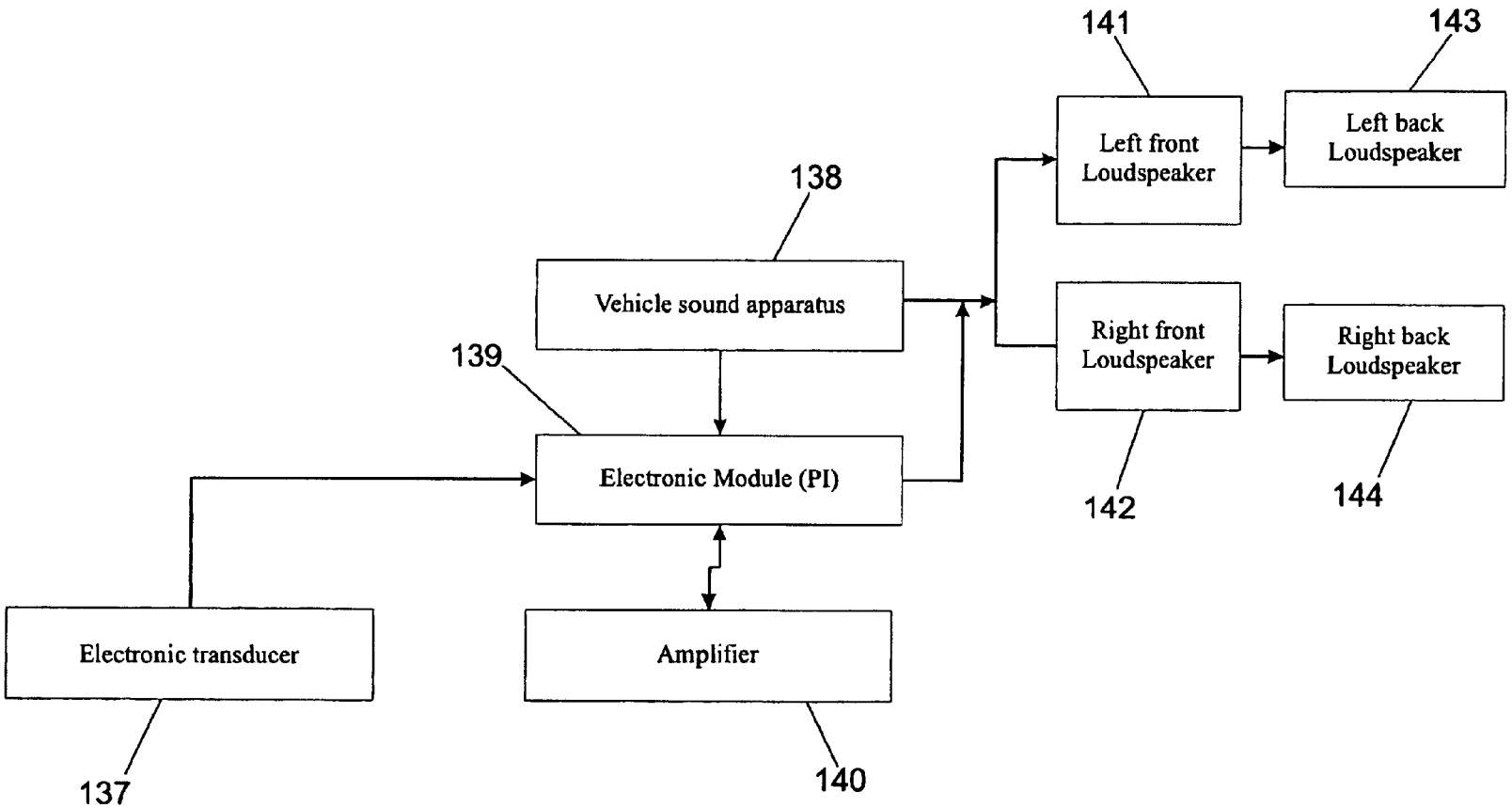
FIG. 14 is a block diagram of the connections of the arrangement of a rhythmic apparatus with a vehicle sound apparatus of this invention.

According to a preferred embodiment and as shown in FIG. 14, the arrangement of a rhythmic apparatus with a vehicle sound apparatus is formed by an electronic module 139, an electronic transducer 137 and an amplifier 140, which are associated with the vehicle sound apparatus 138 and, accordingly, connected to the left front speaker 141, to the right front speaker 142, to the left back speaker 143 and to the right back speaker 144.

Figure 1:
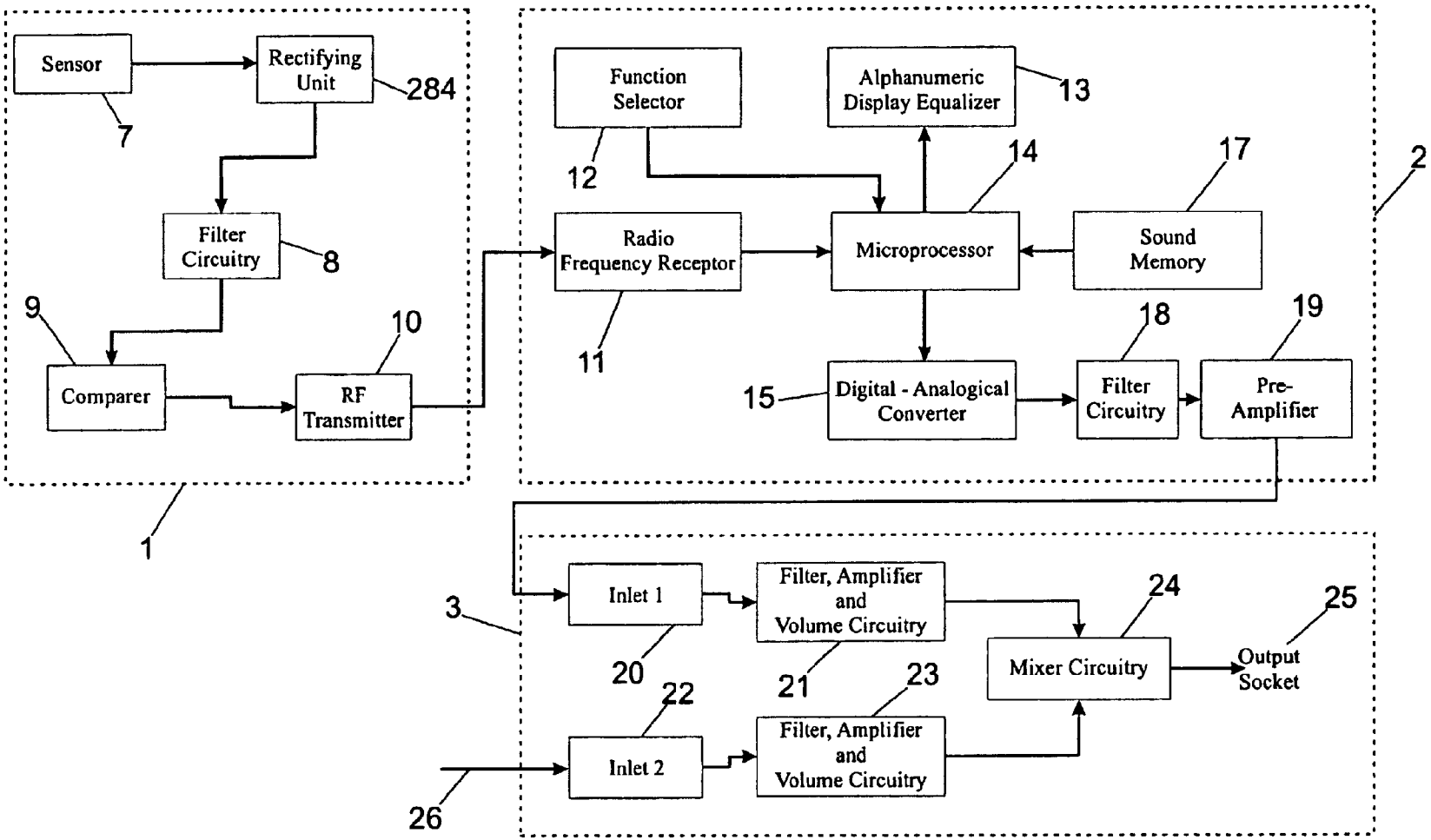
FIG. 1 is a block diagram of an arrangement of a rhythmic apparatus with a vehicle sound apparatus of this invention.

As shown in FIG. 1, the electronic module 139 comprises an electronic transducer 1, a processing unit 2 and a mixer unit 3.

The electronic transducer 1 has a vibration sensor 7, a rectifying unit 284, a first filter circuitry 8, a comparer 9 and a transmitter 10.

Figure 3:
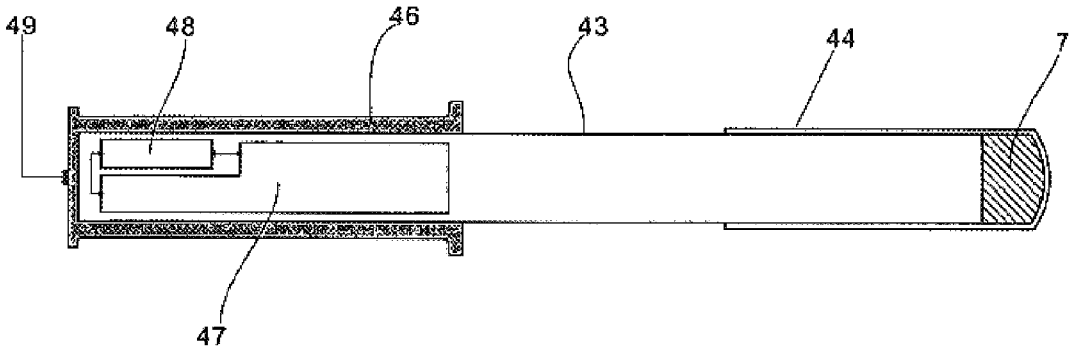
FIG. 3 is a schematic view of the electronic transducer of the apparatus of this invention.

FIG. 3 illustrates a first embodiment of the electronic transducer 1, where the transducer 1 has the shape of a cylindrical drumstick 43 with or without a consistent section, comprised of a rigid polymeric material, for example, PVC, which provides the transducer 1 the features of lightness, hardness and strength. In this embodiment, the electronic transducer 1 comprises, in a first end, a vibration sensor 7, preferably piezoelectric, which is attached to a first transducer 1 end through a cylindrical rubber screened shock 44 and connected to an electronic circuitry 47 positioned at a second transducer 1 end.

This electronic circuitry 47 is preferably comprised of operational amplifiers, a radio frequency (RF) transmitter 10 and a twelve volt battery 48. Also coupled to the circuitry 47 is an on/off button 49.

The transducer 1 further comprises a handle 46 made of aired or foamed rubber, coupled to the second end.

When excited, the vibration sensor 7 emits a signal with electrical pulses of varying frequencies and amplitudes, which are rectified in the rectifying unit 284. Thereafter, these pulses are filtered in the first filter circuitry 8 and then sent to the comparer circuitry 9, which compares the signal to pre-established force levels, so that the digital signal can be defined, which will be emitted by radio frequency transmitter 10 to the processing unit 2.

Figure 15:
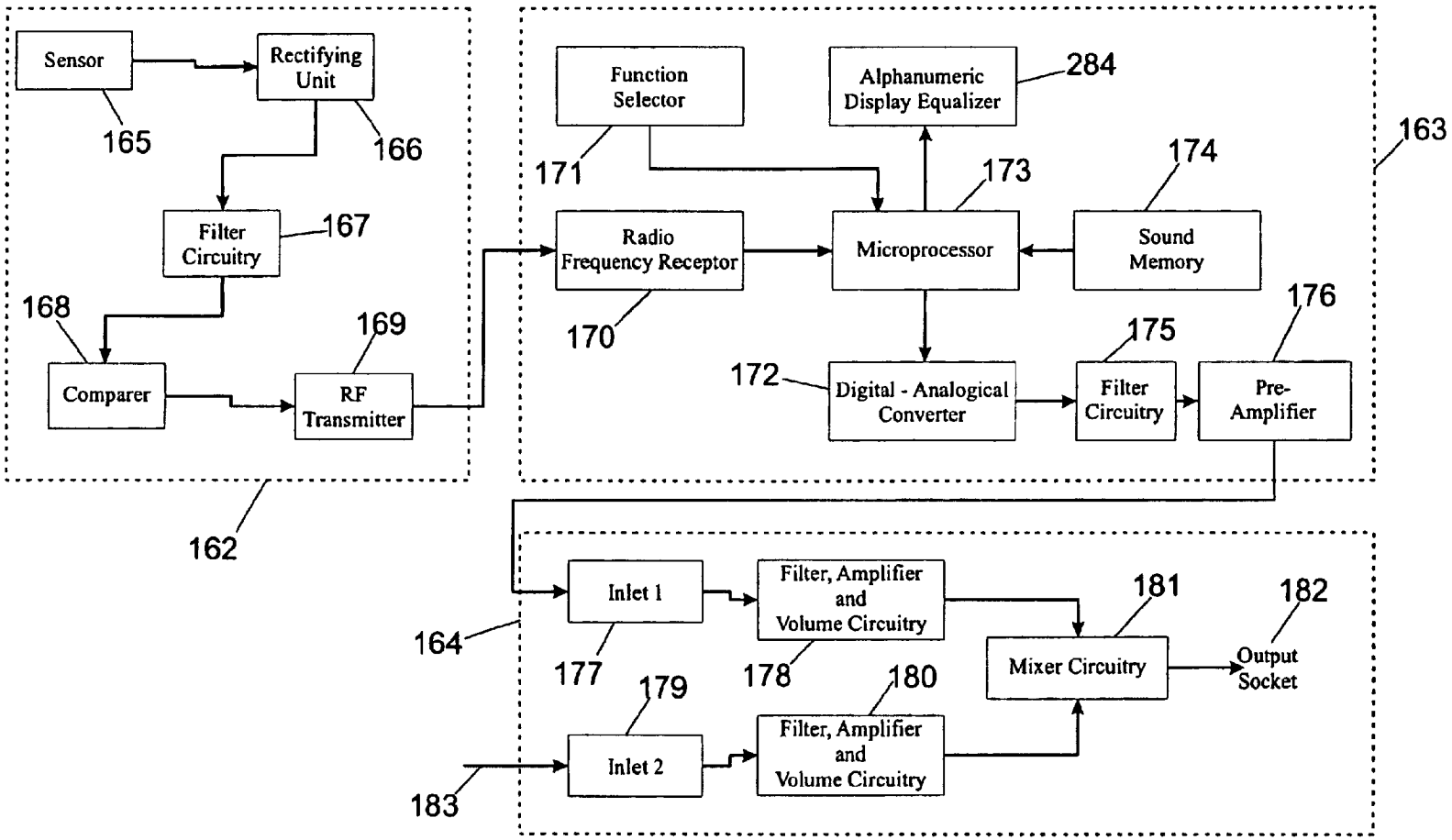
FIG. 15 is a block diagram of a fourth embodiment of the arrangement of a rhythmic apparatus with a vehicle sound apparatus illustrated in FIG. 1.

According to FIGS. 1 and 15, the processing unit 2 comprises a radio frequency receptor 11, a function selector 12, an alphanumeric equalizer dial or display 13, a microprocessor 14, a digital-to-analog converter 15, sound memory 17, a second filter circuitry 18 and a pre-amplifier 19.

The user selects, in the sound memory 17, a sound of the instrument of his/her preference through the function selector 12. This memory 17 stores, digitally, several kinds of percussion sounds such as, for example, cymbals, bass drum, ximbau, muffled drum, among others. The number or name of the sound chosen appears on display 13 and from this choice the unit 2 plays such selected sound with defined amplitude and according to the excitation frequency provided by the transducer 1.

The processing unit 2 senses the digital signal transmitted by the electronic transducer 1 through the radio frequency receptor 11 and transmits to the microprocessor 14 which, with the excitation pace, forms the rhythmic standard which comprises the accompaniment of some relevant song. The previously chosen sound is converted from digital to analog 15 passing, thereafter, to the second filter circuitry 18 and afterward to the pre-amplifier 19.

The output signals from the processing unit 2 are sent to the mixer unit 3, which comprises a first inlet 20, a third filter circuitry and a volume amplifier 21, a second inlet 22, a fourth filter circuitry and a volume amplifier 23, a mixer circuitry A24 and an outlet socket 25.

The mixer unit 3 receives the audio signal from the electronic transducer 1 through the first inlet 20 and mixes it with the audio signal from the vehicle sound apparatus 26 and which enters the unit 3 through the second inlet 22. The audio signal of the first inlet 20 passes through the third filter circuitry and volume amplifier 21 while the audio signal form the second inlet 22 passes through the fourth filter circuitry and volume amplifier 23 and, thereafter, join together in the mixer circuitry 24. This circuitry A24 generates a mixed audio signal, which will pass to the vehicle speakers through the outlet socket 25.

The electronic transducer 1 is fed by a twelve volt battery cell, while the processing unit 2 and the mixer unit 3 are fed by the vehicle battery of about twelve volts.

Figure 5:
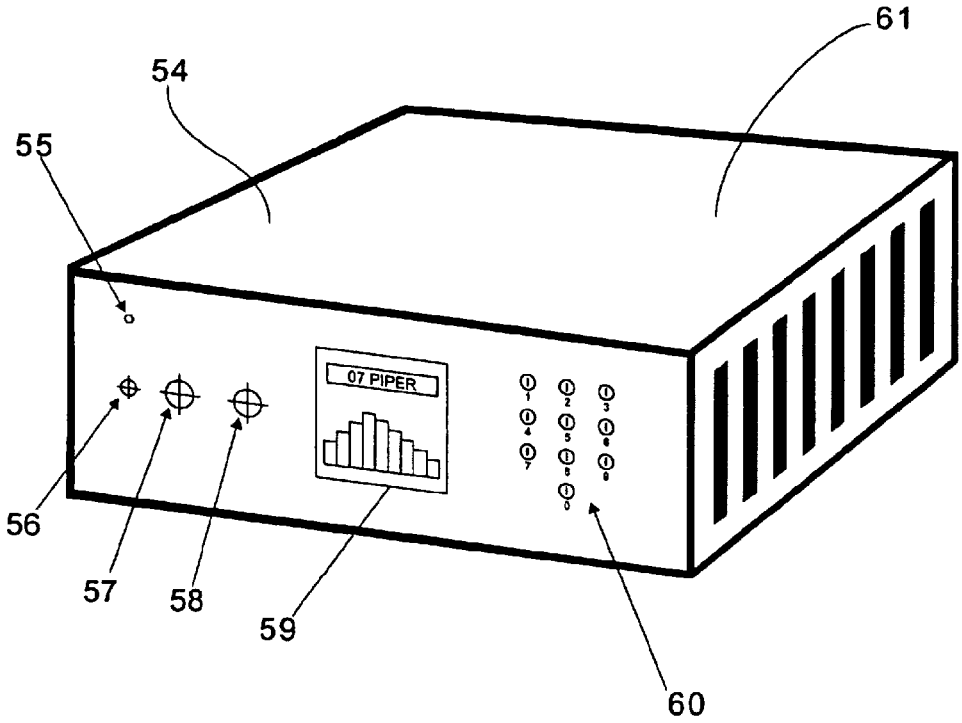
FIG. 5 is a perspective view of the electronic module of the apparatus of this invention.

FIG. 5 illustrates the outer portion of the electronic module comprised of a plastic or metal lodging box 54 comprising, on one of its faces, an LED 55 indicating that the module is on, an on/off button 56, a vehicle sound volume button 57, a volume button 58 of the transducer 1, an alphanumeric dial or display 59 with equalizer and buttons from 0 to 9 to type the chosen sound number.

The processing unit 2 and mixer unit 3 are coupled inside the box 54.

This apparatus is fed by the twelve volt vehicle battery.

Figure 2:
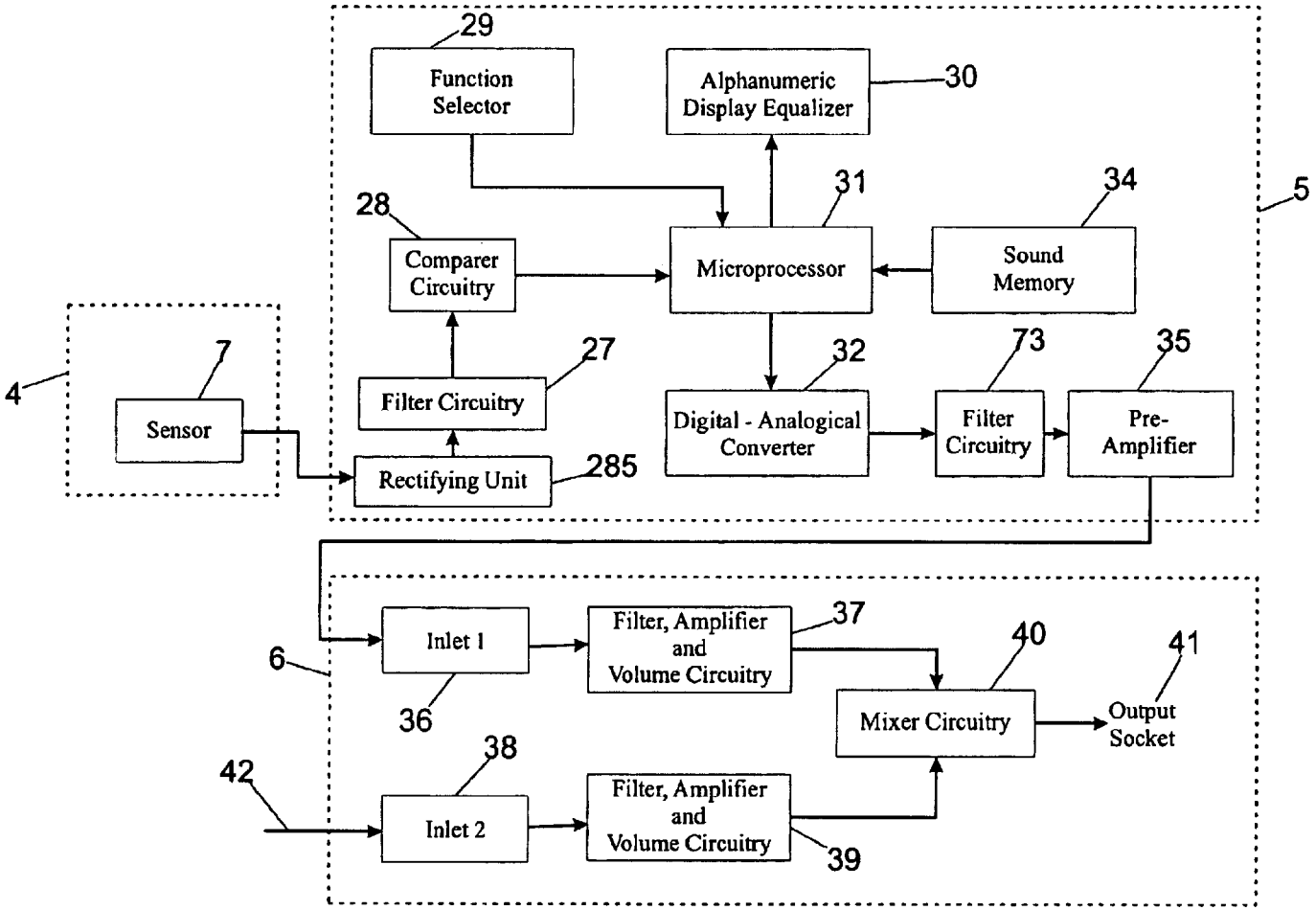
FIG. 2 is a block diagram of a second embodiment of the arrangement of a rhythmic apparatus with a vehicle sound apparatus.
Figure 16:
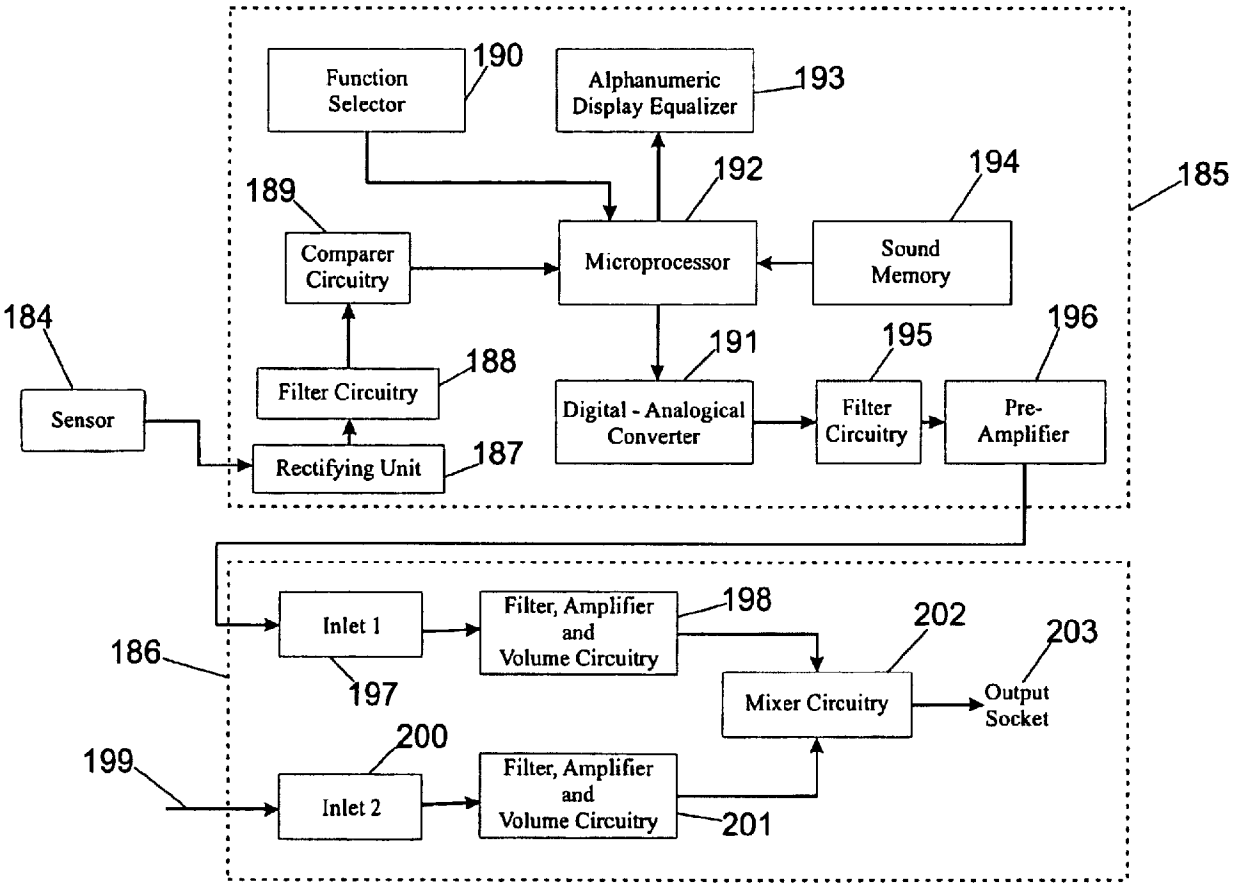
FIG. 16 is a block diagram of a fifth embodiment of the arrangement of a rhythmic apparatus with a vehicle sound apparatus illustrated in FIG. 1.

FIGS. 2 and 16 illustrate a block diagram of a second embodiment of the arrangement of a rhythmic apparatus with a vehicle sound apparatus. According to FIG. 2, the electronic module 139 comprises an electronic transducer 4, a processing unit 5 and a mixer unit 6.

Figure 4:
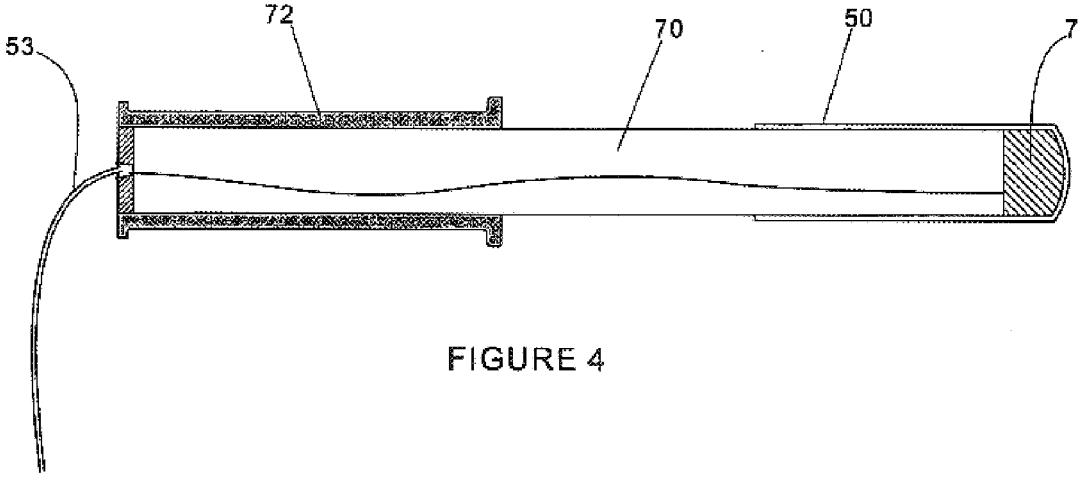
FIG. 4 is a schematic view of a second embodiment of the electronic transducer illustrated in FIG. 3.

FIG. 4 illustrates a second embodiment of the electronic transducer, in which the transducer 4 has the shape of a cylindrical drumstick 70 with or without a consistent section, comprised of a rigid polymeric material, for example, PVC, which provides the transducer 4 features of lightness, hardness and strength. In this embodiment, the electronic transducer 4 comprises, in a first end, a vibration sensor 7, preferably piezoelectric, which is attached to a first transducer 4 end through a cylindrical rubber screened shock 44. The sensor 7 is connected to a jack-type switch positioned in a second transducer 4 end.

The transducer 1 further comprises a handle 72 made from aired or foamed rubber, coupled to the second end.

When excited, the vibration sensor 7 emits a signal with electrical pulses of varying frequencies and amplitudes which are transmitted to the processing unit 5, through transmission by electrical cables 53.

According to FIGS. 2 and 16, the processing unit 5 comprises a rectifying unit 285, a first filter circuitry 27, a comparer circuitry 28, a function selector, an alphanumeric equalizer dial or display 30, a microprocessor 31, a digital-to-analog converter 32, sound memory 34, a second filter circuitry 73 and a pre-amplifier 35.

The user selects, in the sound memory 34, a sound of the instrument of his/her preference through the function selector 29. This memory 34 stores, digitally, several kinds of percussion sounds such as, for example, cymbals, bass drum, ximbau, muffled drum, among others. The number or name of the sound chosen appears on display 30 and, from this choice, unit 5 plays such selected sound with defined amplitude and according to the excitation frequency designed for the transducer 4.

The processing unit 5 receives the digital signal transmitted by electronic transducer 4 through cable 53. This signal, with electrical pulses of varying frequencies and amplitudes, is rectified in the rectifying unit 285 and, through electrical cables, passes to the first filter circuitry 27, thereafter being sent to the comparer circuitry 28, which compares this signal to the preestablished force levels, in order to define the digital signal which will be emitted by the processing unit 31.

The excitation pace of the transducer 4 forms the rhythmic standard, which comprises the accompaniment of some relevant song. The previously chosen sound passes from microprocessor 31, to the digitavanalogical converter 32, then to a second filter circuitry 73 and finally to a pre-amplifier circuitry 35.

The output signals from the processing unit 5 are sent to the mixer unit 6, which comprises a first inlet 36, a third filter circuitry and volume amplifier 37, a second inlet 38, a fourth filter circuitry and a volume amplifier 39, a mixer circuitry 40 and an outlet socket 41.

The mixer unit 6 receives the audio signal from the electronic transducer 4 through the first inlet 36 and mixes it with the audio signal from the vehicle sound apparatus 42 which enters the unit 6 through the second inlet 38. The audio signal of the first inlet 36 passes through the third filter circuitry and volume amplifier 37 and the audio signal form the second inlet 38 pass through the fourth filter circuitry and volume amplifier 39 and, thereafter, join together in the mixer circuitry 40. This circuitry 40 generates a mixed audio signal, which will pass to the vehicle speakers through the outlet socket 41.

The processing unit 5 and the mixer unit 6 are fed by a vehicle battery of about twelve volts.

Figure 6:
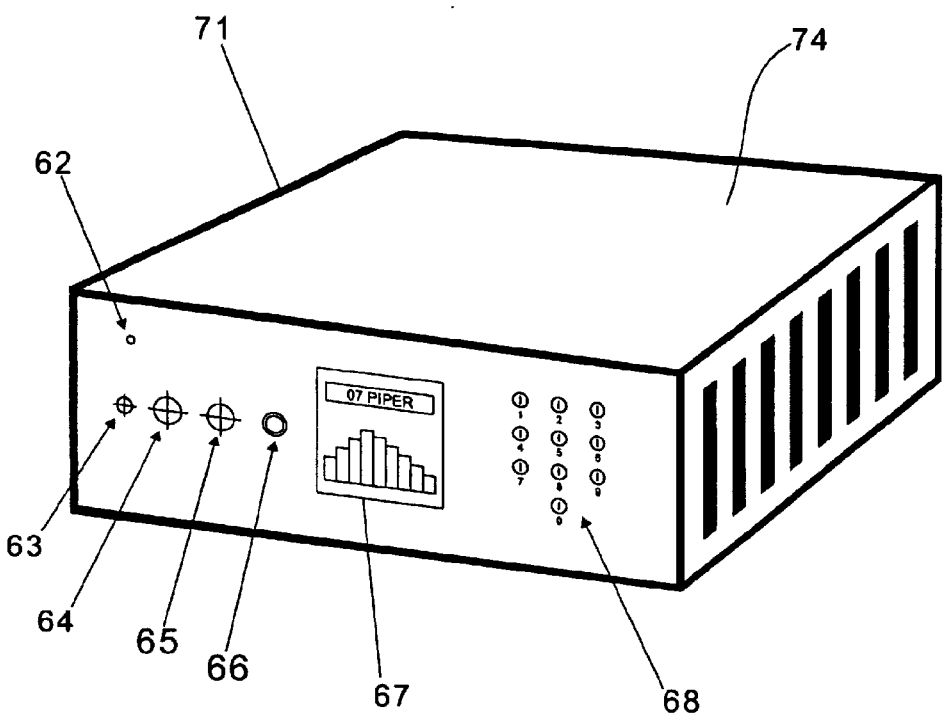
FIG. 6 is a perspective view of a second embodiment of the electronic module illustrated In FIG. 5.

FIG. 6 illustrates the outer portion of the electronic module which is comprised of a plastic or metal lodging box 71 comprising, on one of its faces, a LED 62 indicating that the module is on, an on/off button 63, a vehicle sound volume button 64, a volume button 65 of the transducer 4, a connector 66 which receives the electrical cables from the transducer 4, an alphanumeric dial or display 67 with equalizer and buttons 68 from 0 to 9 to type the chosen sound number.

The processing unit 5 and the mixer unit 6 are coupled inside the box 54.

This apparatus is fed by the twelve volt vehicle battery.

Figure 7:
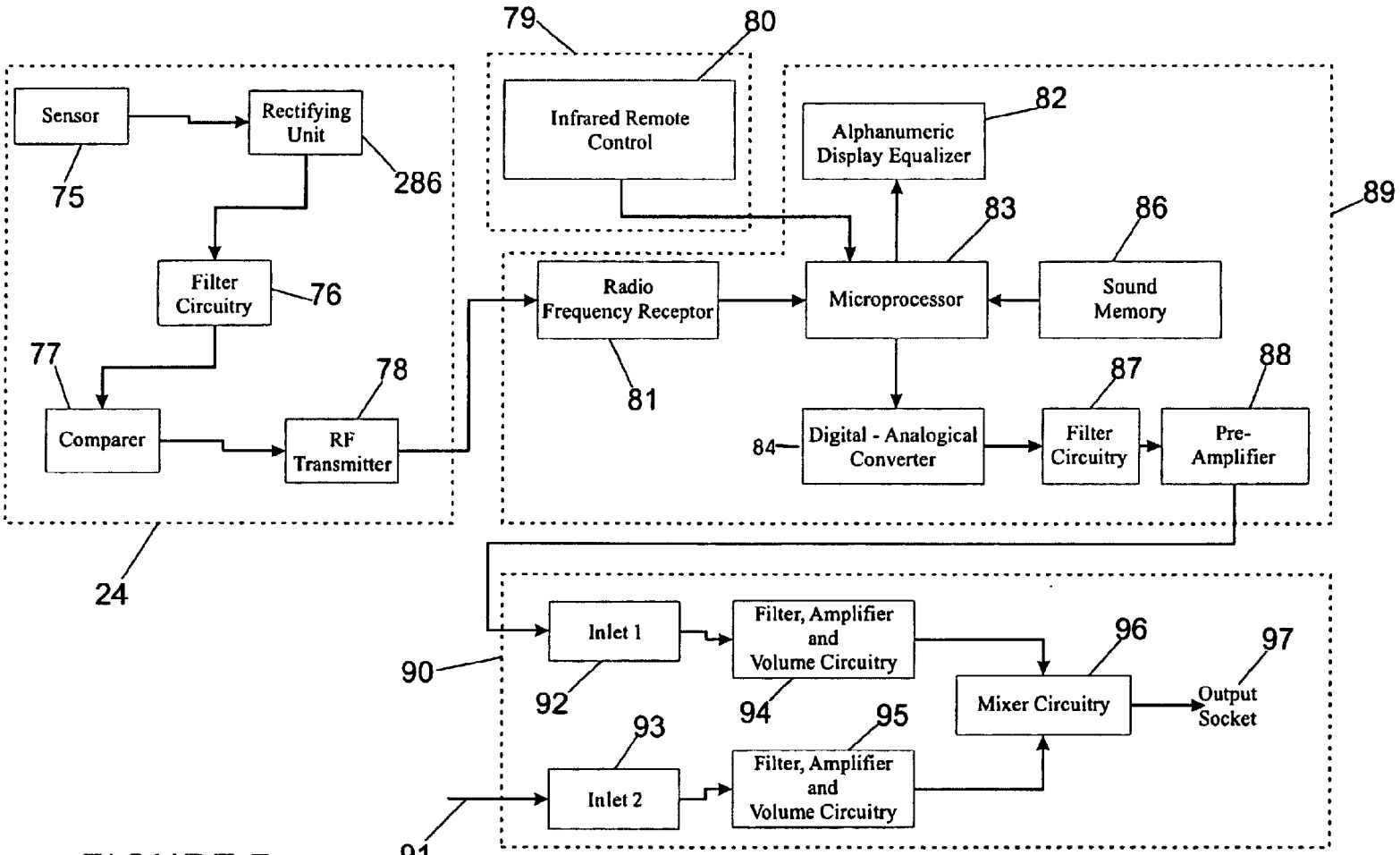
FIG. 7 is a block diagram of a third embodiment of the arrangement of a rhythmic apparatus with a vehicle sound apparatus illustrated in FIG. 1.

FIG. 7 illustrates a third embodiment of the arrangement of a rhythmic apparatus with a vehicle sound apparatus which has an electronic module 100 which comprises an electronic transducer 24, a processing unit 89, a mixer unit 90 and a remote control circuitry 79.

The electronic transducer 24 has a vibration sensor 75, a rectifying unit 286, a first filter circuitry 76, a comparer 77 and a transmitter 78.

When excited, the vibration sensor 75 emits a signal with electrical pulses of varying frequencies and amplitudes which are rectified in the rectifying unit 285. These pulses are filtered in the first filter circuitry 76 and then sent to the comparer circuitry 77, which compares the signal to preestablished force levels, so the digital signal can be defined, which will be emitted by the radio frequency transmitter 78 to the processing unit 89.

According to FIG. 7, the processing unit 89 comprises a radio frequency receptor 81, an alphanumeric equalizer dial or display 82, a microprocessor 83, a digital-analogical converter 84, a sound memory 84, a second filter circuitry 87 and a pre-amplifier 88.

The processing unit comprises a stress regulator (not shown).

The user selects, in the sound memory 86, a sound of the instrument of his/her preference through the remote control circuitry 79, which comprises an infrared remote control 80. This memory 86 digitally stores several kinds of percussion sounds such as, for example, cymbals, bass drum, ximbau, muffled drum, among others. The number or name of the sound chosen appears on display 82 and, from this choice, unit 89 plays such selected sound with defined amplitude and according to the excitation frequency designed for the transducer 24.

The processing unit 89 senses the digital signal transmitted by the electronic transducer 24 through the radio frequency receptor 81 and transmits to the microprocessor 83, which, with the excitation pace, forms the rhythmic standard which comprises the accompaniment of some relevant song. The previously chosen sound is converted from digital to analog 84 passing, thereafter, to the second filter circuitry 87 and afterward to the preamplifier 88.

The output signals from the processing unit 89 are sent to the mixer unit 90, which comprises a first inlet 92, a third filter circuitry and a volume amplifier 94, a second inlet 93, a fourth filter circuitry and a volume amplifier 95, a mixer circuitry 96 and an outlet socket 97.

The mixer unit 90 receives the audio signal from the electronic transducer 24 through the first inlet 92 and mixes it with the audio signal from the vehicle sound apparatus 91 and which enters the unit 90 through the second inlet 93. The audio signal of the first inlet 92 passes through the third filter circuitry and volume amplifier 94 and the audio signal form the second inlet 93 pass through the fourth filter circuitry and volume amplifier 95 and, thereafter, join together in the mixer circuitry 96. This circuitry 96 generates a mixed audio signal which will pass to the vehicle speakers through the outlet socket 97.

The electronic transducer 24 is fed by a twelve volt battery cell, while the processing unit 89 and the mixer unit 90 are fed by the automotive vehicle battery of about twelve volts.

Figure 8:
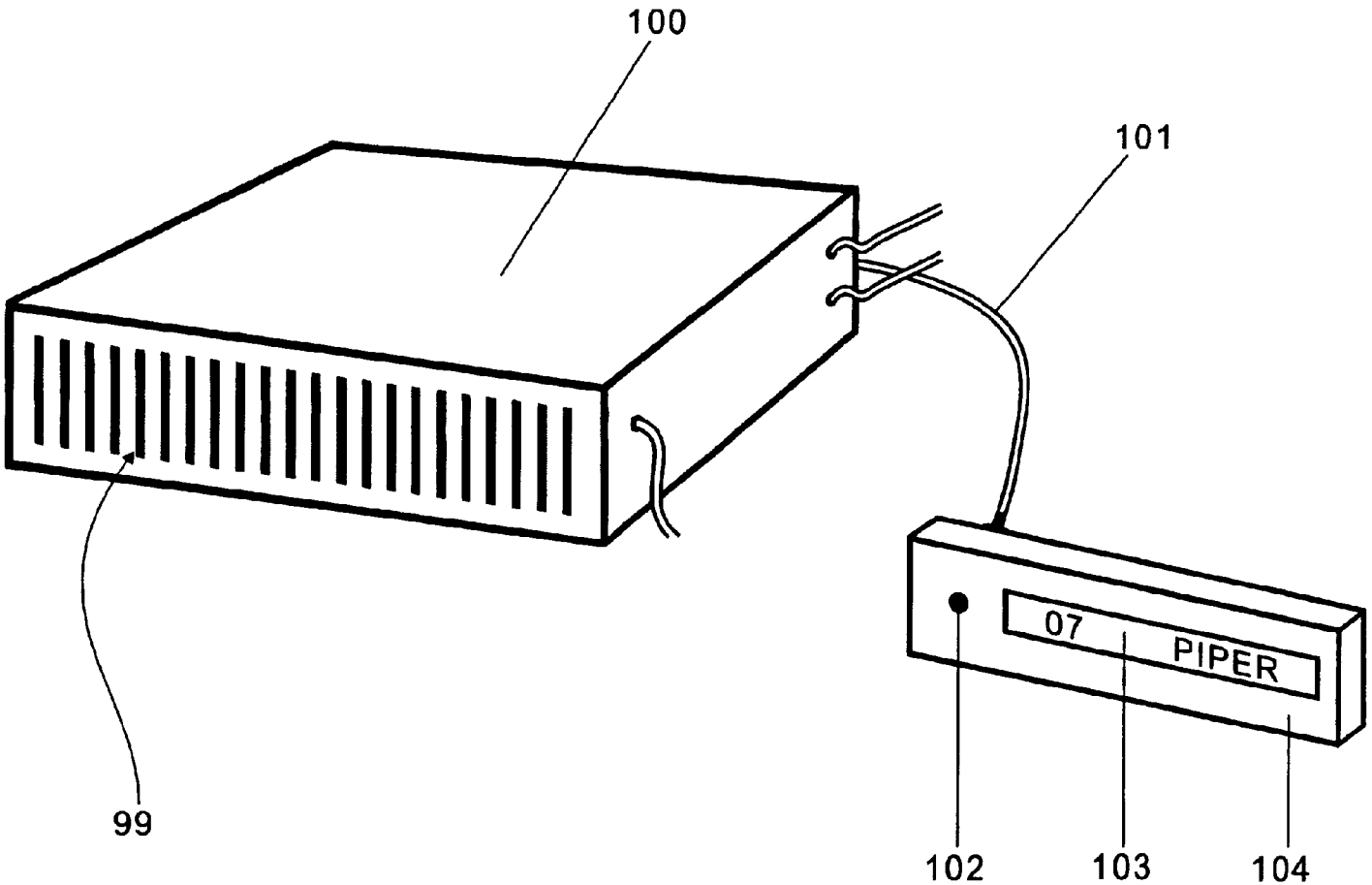
FIG. 8 is a perspective view of a third embodiment of the electronic module illustrated in FIG. 5.

FIG. 8 illustrates an outer portion of the electronic module 100 comprised of a plastic or metal lodging box and which has vent ribs 99 in one of its faces.

Figure 25:
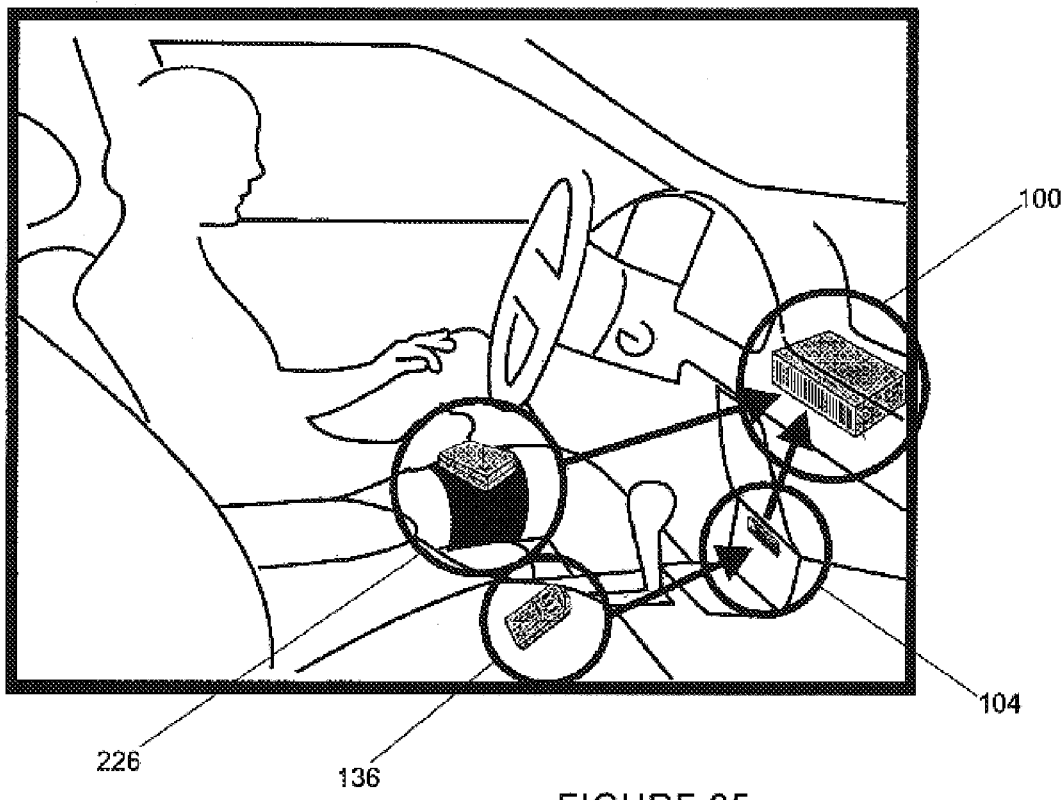
FIG. 25 is a schematic view of the interior of a vehicle and the arrangement of a rhythmic apparatus with the vehicle sound apparatus of this invention.

As can be seen by FIG. 25, the module 100 is placed under the vehicle panel, in non apparent place, and connected to a device 104 through electrical cables. Such device 104 is fixed to the panel and comprises an on/off button 102, an alphanumeric dial or display 103 where the number and the name of the selected song will appear through an infrared remote control 136.

Figure 13:
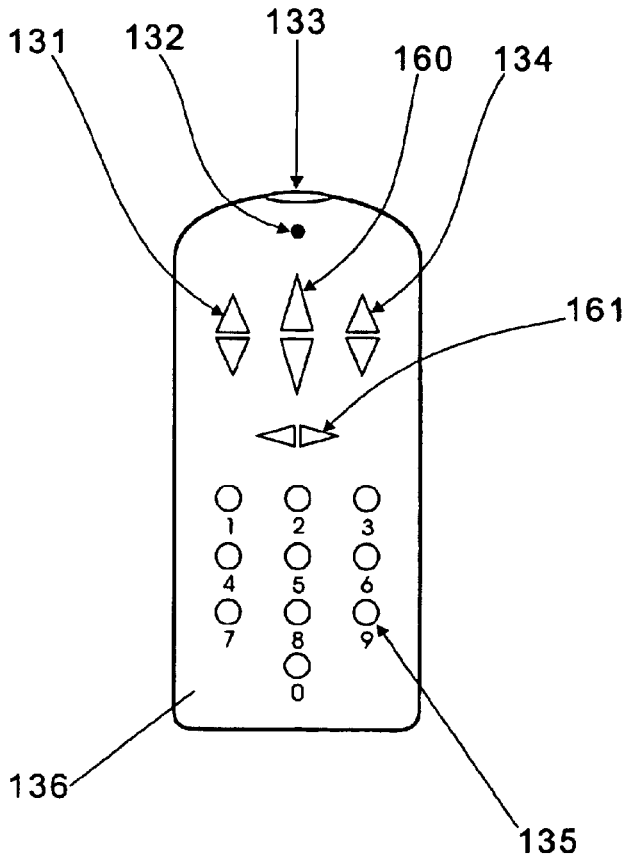
FIG. 13 is a schematic front view of the remote control of the arrangement of a rhythmic apparatus with a vehicle sound apparatus of this invention.

According to FIG. 13, the infrared remote control 136 comprises a plastic box 136, a first selector button 131 of the vehicle sound volume control, a second selector button 134 of the sound volume of the electronic transducer, an on/off button 132, an infrared ray beam emitter receptacle 133, selection buttons 135 of the chosen sound number, a potentiometer 160 and a sequential search device 161.

Through the potentiometer 160, the remote control can control the sound after it is mixed; that is, it controls the sequential search device 161 forward and backward in order to choose the digital sounds and it controls the energy supply to the apparatus through the on/off button 132, in addition to controlling the sound volume both of the transducer 24 and the vehicle sound volume. Such control signals are sent through the infrared ray emission receptacle 133 and received by the remote control circuitry 79.

Figure 9:
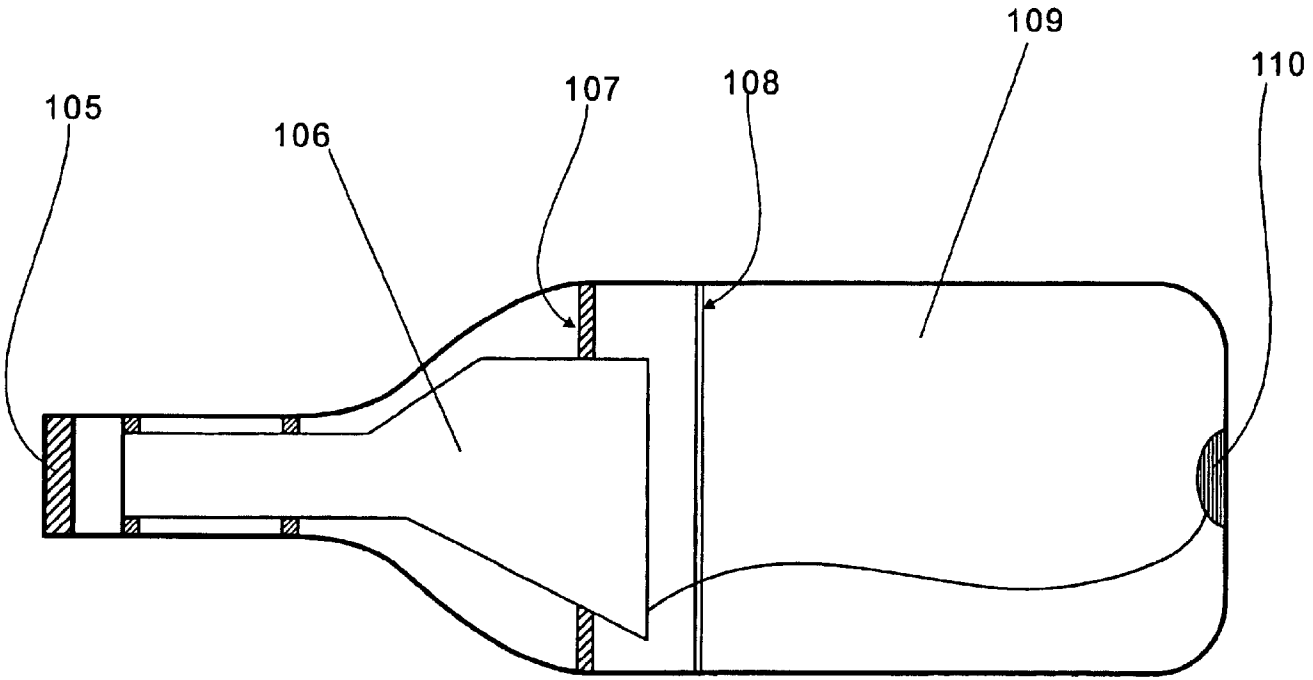
FIG. 9 is a schematic view of a third embodiment of the electronic transducer illustrated in FIG. 3.

FIG. 9 illustrates a third embodiment of the electronic transducer in shape of a bottle 109, made of plastic material similar to a plastic soda or mineral water bottle, having signal transmission means through radio frequency waves to the electronic module 139, more precisely to the processing unit 2.

The bottle-shaped transducer 109 has a cylindrical shape with varying sections, made of a rigid polymeric material and having an internal vibration sensor 110 preferably piezoelectric, attached to the first bottle end through a cylindrical screened rubber shock. The vibration sensor 110 is connected to an electronic circuitry 106 positioned at a second end and attached through radial shocks 107, which enclose the circuit board 106.

This electronic circuitry 106 is preferably composed of operating amplifiers, radio frequency (RF) transmitter and a twelve volt battery, a comparer circuitry and a filter circuitry. Also coupled to the circuitry 106 is an on/off button positioned in the bottle cap 105, which is split and can be open at a hinge 108. The bottle 109 shall be held at its smaller section.

Figure 10:
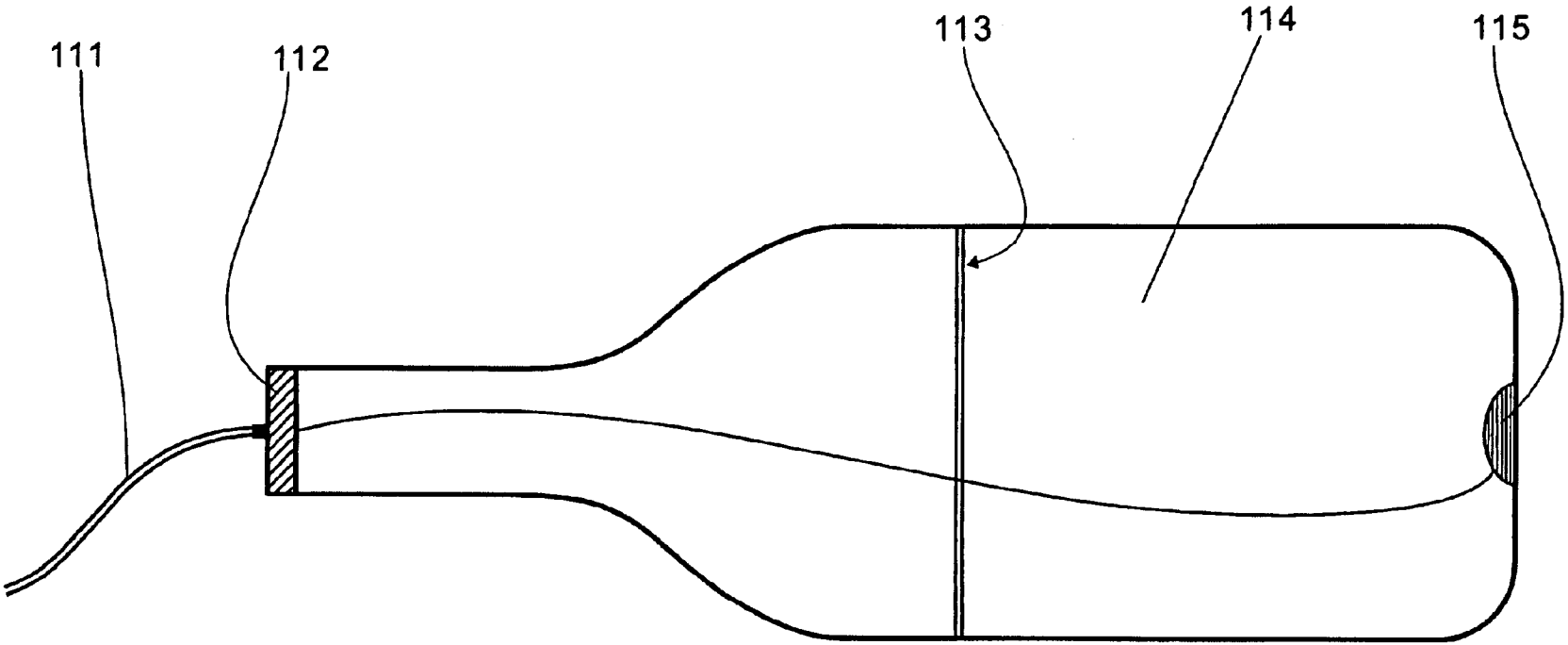
FIG. 10 is a schematic view of a fourth embodiment of the electronic transducer illustrated in FIG. 3.

FIG. 10 illustrates a fourth embodiment of the electronic transducer, in which the transducer has the shape of a cylindrical bottle 114 with varying section, made of a rigid polymeric material and having an internal vibration sensor 115, preferably piezoelectric, attached to a first bottle end through a cylindrical screened rubber shock. The vibration sensor is connected to a jack-type switch proximate to a second bottle end 112 and, through electrical cables 111, this bottle-shaped transducer 114 is electrically connected to the electronic module, more precisely to a processing unit 5.

The bottle 114 is split and can open at the hinge 113. The bottle 114 is held at its smaller section.

Figure 11:
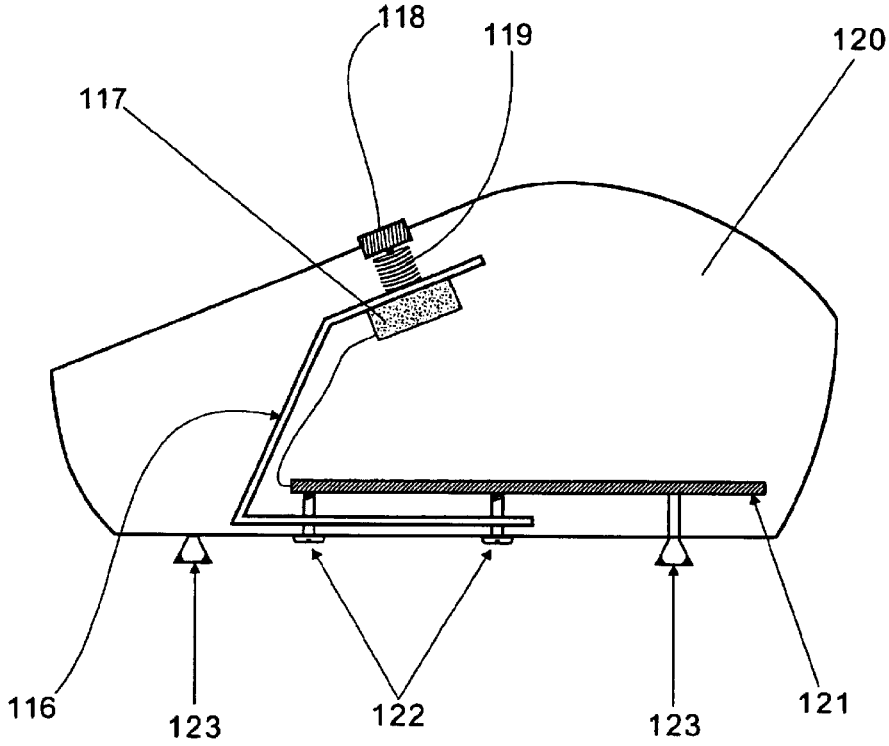
FIG. 11 is a schematic view of a fifth embodiment of the electronic transducer illustrated in FIG. 3.

FIG. 11 illustrates an electronic transducer 120 similar to a computer mouse and which transmits electronic signals, emitted by manual touch, through radio frequency waves to the electronic module 139, more precisely to the processing unit 2.

This transducer 120 is comprised of a plastic or metal box, venting support 123 for fixing it to some surface, as for example over the vehicle panel, in the vehicle dashboard, etc. and an electronic circuitry 121.

The electronic circuitry 121 is preferably composed of operating amplifiers, radio frequency (RF) transmitter 10, a twelve volt battery 48, a comparer circuitry 9, a first filter circuitry 8, a rectifying unit 284 and other circuitries.

A vibration sensor 117, preferably piezoelectric, is attached to a first inner portion of a flexible board 116. A touch button 118 is fixed on a stainless steel spring 119, in a second outer portion of the flexible board 116, so that it protrudes to the transducer box 120.

The button 118 has the function of receiving the rhythm impact transmitted by the hands or feet of the user of the rhythmic apparatus. This impact is absorbed by the button 118, which, in conjunction with the spring 119, moves the flexible board 116. Then the vibration sensor 117 is excited, transmitting signals to the electronic circuitry 121, which, in turn, will transmit them to the electronic module 139.

Figure 12:
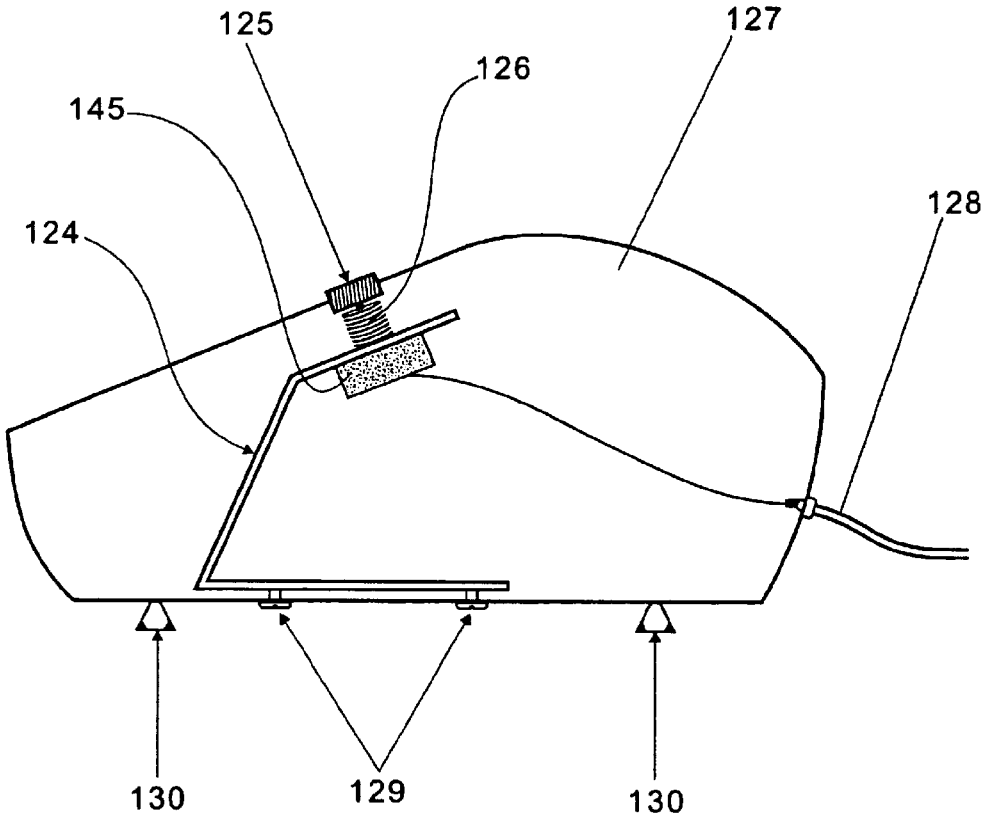
FIG. 12 is a schematic view of a sixth embodiment of the electronic transducer illustrated in FIG. 3.

FIG. 12 illustrates an electronic transducer 127 similar to a computer mouse and which transmits the electronic signals, emitted by manual touch, through electrical cables 128 to the electronic module 139, and more precisely to the processing unit 5.

This transducer 127 is comprised of a plastic or metal box and venting support 130 for fixing it to some surface and a vibration sensor 145.

This vibration sensor 145, preferably piezoelectric, is fixed to a first inner portion of a flexible board 124. A touch button 125 is fixed on a stainless steel spring 126, in a second outer portion of the flexible board 124, so that it protrudes to the transducer box 127.

The button 125 has the function of receiving the rhythmic impact transmitted by the hands of the user of the rhythmic apparatus. This impact is absorbed by a button 125, which, in conjunction with a spring 126, moves the flexible board 124. Then the vibration sensor 145 is excited, transmitting signals to the electronic module 139. Fixating elements 129 attach the flexible board 124 to a lower inner portion of the transducer box 127, proximate to the vents 130.

Figure 17:
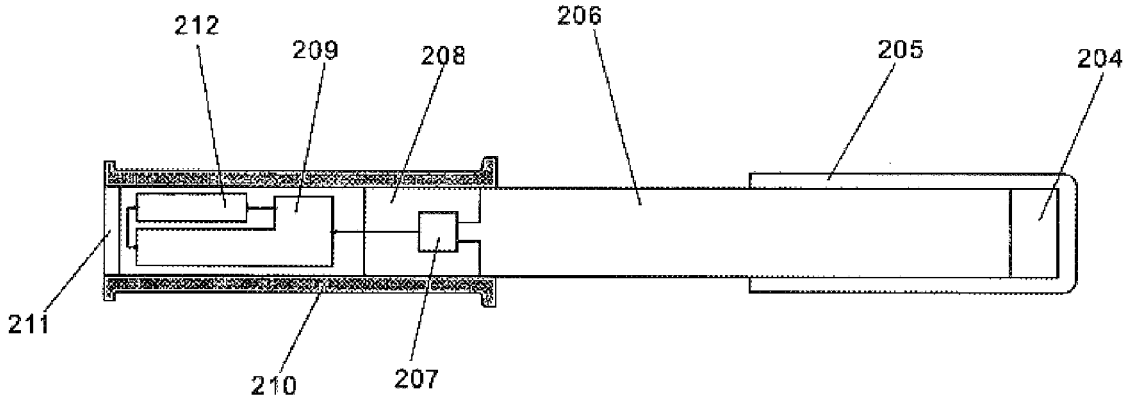
FIG. 17 is a schematic view of a seventh embodiment of the electronic transducer illustrated in FIG. 3.

FIG. 17 illustrates a seventh embodiment of the electronic transducer, where this transducer 206 has the shape of a cylindrical drumstick with or without consistent sections, made of a rigid polymeric material, for example, PVC, which provides the transducer 206 features such as lightness, rigidity and strength. In this embodiment, the electronic transducer 206 comprises, in a first end 205 lined by rubber 204 and an electric vibration sensor 207 fixed in the center of the transducer 206 tube by a rubber cylindrical shock 208. The electric vibration sensor 207 is connected to an electronic circuitry 209 positioned near the second transducer 206 end proximate to a twelve volt battery 212.

This electronic circuitry 209 is preferably composed of operating amplifiers, a rectifying unit, a radio frequency (RF) transmitter 10 and a comparer circuitry 9. The handle 210 of the transducer 206 is composed of aired or foamed rubber, while the second end has a rubber shock 211 closing the transducer.

Figure 18:
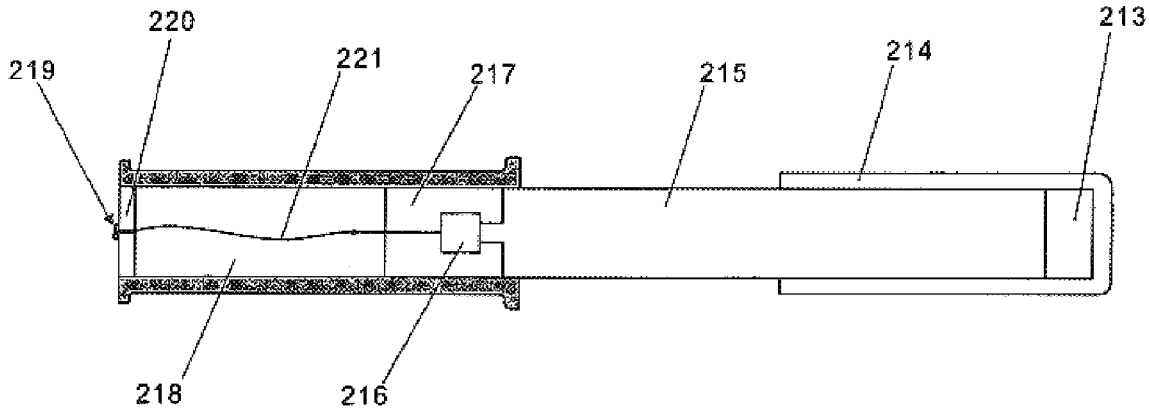
FIG. 18 is a schematic view of a eighth embodiment of the electronic transducer illustrated in FIG. 3.

FIG. 18 illustrates an eighth embodiment of the electronic transducer, in which this transducer 215 has a shape of a cylindrical drumstick with or without consistent sections, made of a rigid polymeric material, for example, PVC, which provides the transducer 215 features such as lightness, rigidity and strength. In this embodiment, the electronic transducer 215 comprises, in a first end 213 lined by rubber 214 and an electric vibration sensor 216 attached to the center of the transducer 215 tube by a rubber cylindrical shock 217. A jack-type switch 219 is positioned in a second transducer end 215, for the connection of the electrical cables 219, which transmit the data emitted by the electric sensor 216 to the module 139.

The handle 218 of the transducer 215 is composed of aired or foamed rubber, while the second end has a rubber shock 220, closing the transducer.

FIG. 19 illustrates a ninth embodiment of the electronic transducer. In this embodiment, the transducer 226 emits signals through radio frequency and comprises a touch element which comprises a pad 223 having fixating means 224 and 222 comprising ties having adhesive portions made of a closure fastener, such as a hook and loop-type fastener and components thereof commonly sold under the trademark VELCRO®.

As seen in FIG. 25, the pad 223 is held to the user's body by ties 224 and 222. The same ties 224 and 222 can hold the pad to the thigh or other places the user considers convenient.

According to FIG. 19-A, the transducer 226 is comprised of a plastic box 234, a sensitive surface 228 comprising, at least, one touch element, stainless steel springs 227, a pin 229, a flexible board 232, a vibration sensor 230 of a piezoelectric type, an electronic circuitry 231 and a labelling shaft 235. Also, the sensitive surface 228 might be provided by two or more touch elements emitting different sounds.

To excite the transducer 226, the user transmits a pressure to the sensitive surface 228, covered by the pad 223, by the impact of his/her fingers 225. This surface 228 absorbs this impact and, through a mild rotation of this surface 228 about the labelling shaft 235, the impact is transmitted to the spring 227, which, in turn, transmits it to the pin 229. Such pin 229 projects on the flexible board 232, which board 232 comprises the vibration sensor 230 fixed in its inner and opposite portions to the region of contact with the pin 229.

The sensor 230 is connected to the electronic circuitry 231. This circuitry comprises a filter circuitry 8, a comparer circuitry 9, a radio frequency (RF) circuitry 10, a twelve volt battery cell and a rectifying unit 284.

The pad 223 comprises a tie 224 positioned in a first end and a tie 222 positioned in a second end opposite to the first end.

FIG. 20 illustrates a tenth embodiment of the electronic transducer. In this embodiment, the transducer 238 emits signals through the electrical cables (not illustrated) and comprises a pad 233 having fixating ties 239 and 240 comprising portions of a closure fastener, such as a hook and loop-type fastener and components thereof commonly sold under the trademark VELCRO®.

As seen in FIG. 25, the pad 233 is held to the user's body by ties 239 and 236. The same ties 239 and 236 can hold the pad to the thigh or other places the user considers convenient.

According to FIG. 20-A, the transducer 238 is comprised of a plastic box 248, a sensitive surface 244 comprising, at least, one touch element, stainless steel springs, a pin 243, a flexible board 247, a vibration sensor 242 of a piezoelectric type and a labelling shaft 246. Also, the sensitive surface 244 might be provided by two or more touch elements emitting different sounds.

To excite the transducer 238, the user transmits a pressure to the sensitive surface 244 by the impact of his/her fingers 237. This surface 244 absorbs this impact and, through a mild rotation of this surface 244 about the labelling shaft 246, the impact is transmitted to the spring 245, which, in turn, transmits it to the pin 243. Such pin 243 projects on the flexible board 247, which board 247 comprises the vibration sensor 242 fixed in its inner and opposite portions to the region of contact with the pin 243.

The sensor 242 is connected through electrical cables to a jack connector 241.

The pad 233 comprises a tie 239 positioned in a first end and a tie 236 positioned in a second end opposite to the first end.

FIG. 21 illustrates an eleventh embodiment of the electronic transducer. In this embodiment, the transducer 250 has the shape of a drum and transmits signals to the electronic module 139 through radio frequency and comprises a pad 253 having fixating ties 251 and 249 comprising portions of a closure fastener, such as a hook and loop-type fastener and components thereof commonly sold under the trademark VELCRO®.

As seen in FIG. 25, the pad 253 is held to the user's body by the ties 251 and 249. The same ties 251 and 249 can hold the pad to the thigh or in other places the user considers convenient.

According to FIG. 21-A, the transducer 250 is comprised of a plastic box 258, a sensitive surface 255 comprising, at least, one touch element, which may be a plastic or metallic membrane, stainless steel springs, a pin 243, a flexible board 247, a vibration sensor 256 of the type piezoelectric which is connected by electrical cables 254 to an electronic circuitry 259. Also, the sensitive surface 255 might be provided by two or more touch elements emitting different sounds.

The electronic circuitry 259 comprises a filter circuitry 8, a comparer circuitry 9, a radio frequency (RF) transmitter, a twelve volt battery cell and a rectifying unit 284.

To excite the transducer 250, the user transmits a pressure to the sensitive surface 255 by the impact of his/her fingers 252. This surface 255 absorbs this impact and transmits it to the vibration sensor 256, which is fixed to an inner portion of the surface 255.

FIG. 22 illustrates a twelfth embodiment of the electronic transducer. In this embodiment, the transducer 261 has the shape of a drum and transmits signals to the electronic module 139 through electrical cables and comprises a pad 269 having fixating ties 262 and 260 comprising portions of a closure fastener, such as a hook and loop type fastener and components thereof commonly sold under the trademark VELCRO®.

The pad 269 is held to the user's body by the ties 262 and 260, as illustrated in FIG. 25. The same tie beams 262 and 260 can hold the pad to the thigh or in other places the user considers convenient.

According to FIG. 22-A, the transducer 250 is comprised of a plastic box 268, a sensitive surface 267 comprising, at least, one touch element, which may be a plastic or metallic membrane, a vibration sensor 266 of a piezoelectric type which is connected to electrical cables 264. Also, the sensitive surface 267 might be provided by two or more touch elements emitting different sounds.

To excite the transducer 261, the user transmits a pressure to the sensitive surface 267 by the impact of his/her fingers 263. This surface 267 absorbs this impact and transmits it to the vibration sensor 266, which is fixed to an inner portion of the surface 267. From the sensor 266, the data are emitted by electrical cables 264 to the electronic module.

Figure 23:
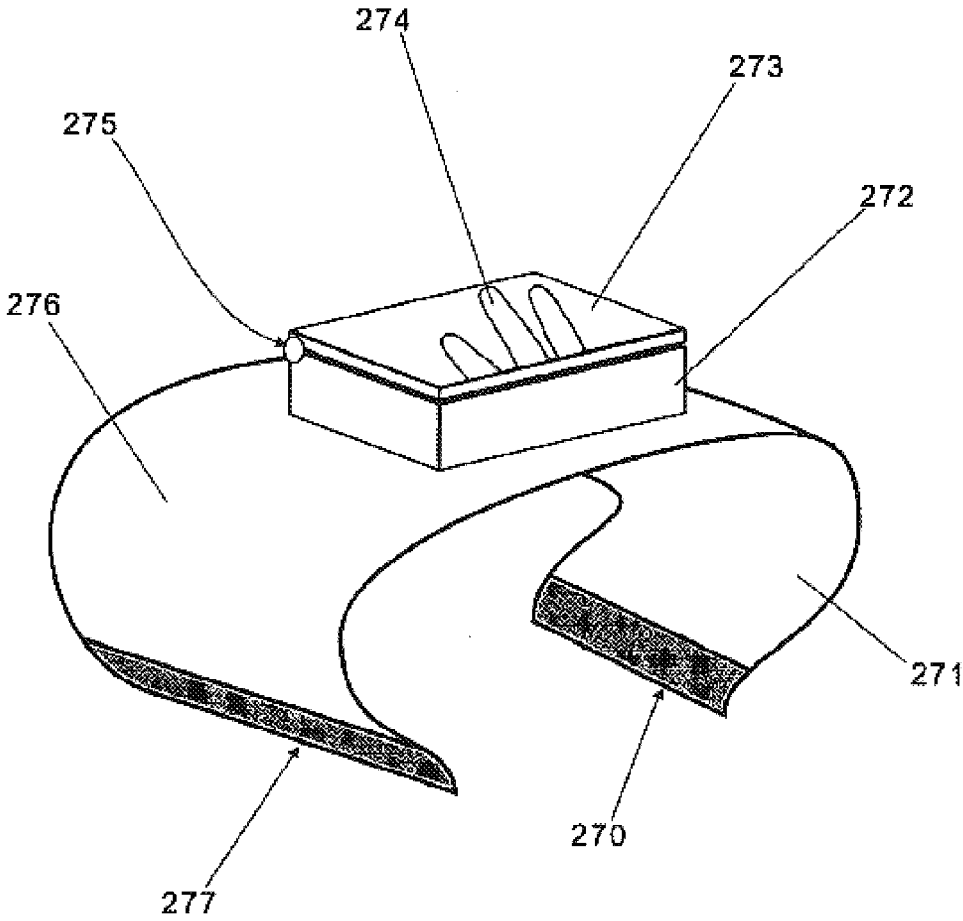
FIG. 23 is a schematic perspective view of the ninth embodiment of the electronic transducer illustrated in FIG. 19.

FIG. 23 better illustrates the embodiments of FIGS. 19 and 20, in which the transducer 226 or 228 has a substantially parallelepiped-shaped format, comprising a pad 223 or 233 on the surface 273, where the user, by contact with fingers 274, transmits rhythmic movements to the transducer, causing it to move mildly around the labelling shaft 275 and which corresponds to shafts 235 and 246 of FIGS. 19A and 20A, transmitting vibrations to the vibration sensor.

The padded ties 276 and 271 illustrate the location of the portions of closure fasteners, such as a hook and loop-type fasteners and components thereof commonly sold under the trademark VELCRO®, 277 and 270.

Figure 24:
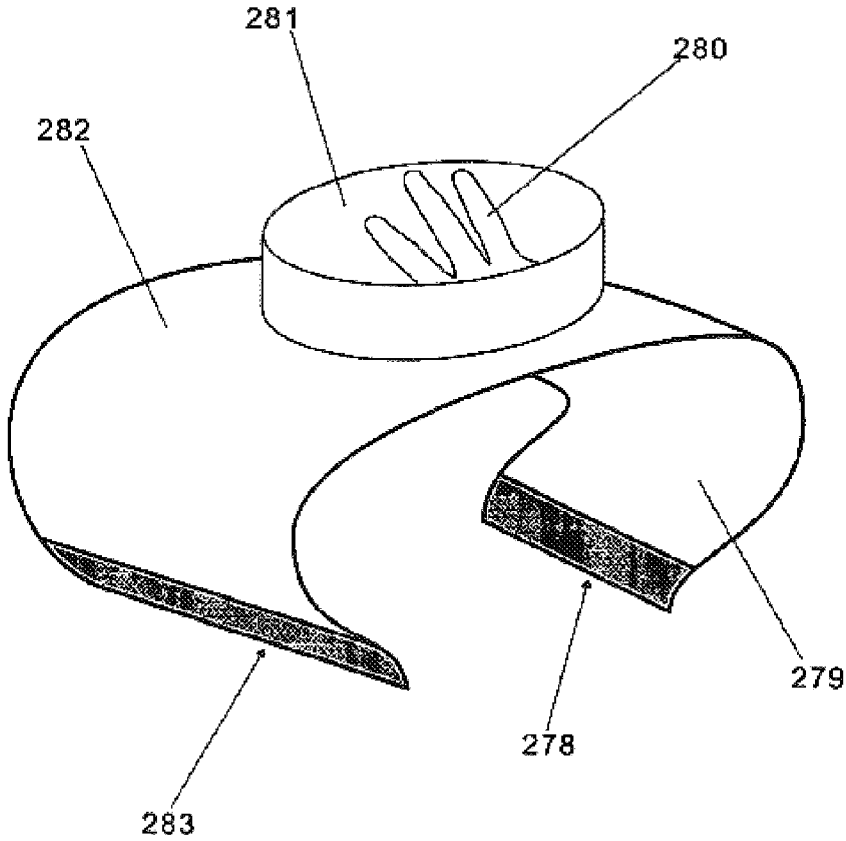
FIG. 24 is a schematic perspective view of the eleventh embodiment of the electronic transducer illustrated in FIG. 21.

FIG. 24 further illustrates the embodiments of FIGS. 21 and 22, in which the transducer 250 or 261 has a substantially circular shape (drum), comprising the pad 253 or 260 on the surface 281, where the user, by contact with fingers 280, transmits rhythmic movements to the transducer, causing the surface 281 to move mildly and transmit vibrations to the vibration sensor.

The padded ties 282 and 279 illustrate the location of the portions of closure fasteners, such as a hook and loop-type fasteners and components thereof commonly sold under the trademark VELCRO®, 283 and 278.

FIG. 25 illustrates the arrangement of a rhythmic apparatus with a vehicle sound apparatus comprising an electronic module 100 placed under a vehicle panel, in a non-apparent place, and connected to a device 104, this device 104 being fixed to the vehicle panel. The electronic module 100 and the device 104 are connected to the vehicle sound apparatus 138.

The arrangement of the rhythmic apparatus with the vehicle sound apparatus, as illustrated in FIG. 25, also comprises an infrared remote control 136 that can control the vehicle sound volume control, the sound volume of the electronic transducer, the chosen sound number and a sequential search device, and an electronic transducer 226 that emits signals to the electronic module 100 through radio frequencies. The electronic transducer 226 comprises at least one touch element, a pad 223, held to the user's body.

Optionally, the electronic module 100 can be manufacture within the vehicle sound apparatus 138 as single part, that is, the vehicle sound apparatus could be made comprising the processing unit and the mixer unit, besides its own ordinary components.

The method of use of the rhythmic apparatus described above comprises the following steps:

a) choosing the first audio signal in the sound apparatus 138;

b) choosing the timbre for the second audio signal in the electronic module 139;

c) emitting the second audio signal through the excitation of the electronic transducer 137; and d) mixing the first audio signal with the second audio signal 139.

After the installation of module 193 in the automotive vehicle panel, the audio from the original vehicle sound apparatus, which can be a radio, cassette player, CD player, MP3 player, minidisk player or other sound player and which are connected to the front and back loudspeakers, is mixed with the sound chosen by the user of the rhythmic apparatus.

The transducer 1 is connected to the electronic module 139, which is connected to the amplifier 140, to the vehicle sound apparatus and to the loudspeakers. All this assembly is connected, as shown in FIG. 14, and is fed by the automotive vehicle twelve volt battery.

The user then chooses a rhythmic song, preferably of his/her personal liking, in the vehicle sound apparatus. Then the user chooses, in the electronic module 139, in its sounds menu, a sound accompaniment, which is similar to the instrumental accompaniment of the song of the vehicle sound apparatus.

Handling the transducer 1, the user begins to excite it against any inner surface of the vehicle, or touching it with the user's hand, so that the same emits sounds, for instance, of percussion and which, with the rhythmic repetition similar to that of the song chosen, will cause the user to feel himself/herself as member of the band.

The user begins to feel the positive effects of the apparatus. This user's task is to follow the rhythmic measures, both in frequency and intensity, of the song from the vehicle sound apparatus. The rhythmic repetition added to the song, movement of the arms, head, neck, shoulders and further strong messages to the brain, causes the practitioner to feel relaxed and well humoured, in addition to keeping him/her concentrated to the song rhythm and the rhythmic standard, which sharpens his/her mind, causing him/her to release and forget the surrounding difficulties.

Another important aspect of the method is that the method enables us to follow a song as if there existed in front of us a percussion instrument with, for instance, eight instruments (cymbals, bass drum, ximbau, muffled drum, etc.), then we could choose one of the eight instruments to follow the song. However, during the song we can use another instrument (obviously stopping use of the previous instrument). A user has a broad range of options and can make sounds, with scarce practice, or almost no musical knowledge.

Preference is given to the percussion sounds, because the percussion is rhythmic, whose notes are short.

The sound timber is more like instruments of the song accompaniment (e.g., if the song has percussive accompaniment of cymbals, then a user can choose a timbre of cymbals stored in the menu of sounds). The sound timbres of musical instruments of the electronic transducer will exit from the loudspeakers, with different intensity, in conjunction with the sound from the CD player, cassette player or radio, which will be playing the song. A user holds the electronic transducer by the handle and beats it on any surface of the vehicle, and every beat or pressure excitation will emit a timbre of the musical instrument sound. A user may try to play this sound timbre of the musical instrument in rhythm with the rhythm of the song (which is easily attainable, without the need of much practice or musical theory). A user may carry out a rhythmic standard, which is similar to that of the song, or at a user's discretion he/she can use the invention in her/her own way without the need of being 100% compatible with the song, the rhythm of the sound from the electronic transducer, with some kind of song accompaniment. A user can, therefore, follow through the ternary rhythm, which is a strong beat and two weak ones, within the pace of the rhythm, or many other rhythms a user may attain in time, forming a rhythmic standard.

One of the benefits of the method is that a user feels as if he/she were a member of the musical band. In time, this accompaniment will cause a user to become more musically refined, and then a user can have a deeper audible sensation, noting the several accompaniments in every song; and as if the user were an experienced musician, the user will be successful in most of songs. The most common of song accompaniments are percussions, but it can be also the strings, horn, keyboard, etc. Also the apparatus is not musically complete, but is designed to the combat stress and bring pleasure to the user.

The driver and/or passengers will have several benefits. With the use of the apparatus through the method described, expressing our deepest desires becomes easier, making them acceptable to the ego, because the user can venture to draw sounds from his/her apparatus, in the most personal manner as possible.

The individual acquires greater mobility, shows and sharpens his/her auditory experience and produces an accompaniment of his/her own form, without the need of being experienced in music. It is emphasized that it is not necessary to be a song student, or great cognizant thereof; anyone in a minimal time can follow the rhythm (sometimes in his/her own manner) and, thus, dive into the song, and get all the satisfaction and the benefits it grants us. The main apparatus and method feature is that it is considered as a vehicle for emotional self-expression.

The driver and/or the passenger who practices the method with the apparatus of the present invention will be well ready, well humoured, he/she will be relaxed, accordingly he/she will improve his/her self-esteem (the person simply is happy with himself/herself), he/she will improve his/her motor coordination (because with the apparatus at work the person will move his/her arms, moving the muscles, articulations, etc), the welfare sensation will increase and the person will recover the lost physical and mental energy, a rejuvenation occurs. With the improvement of self-esteem, the brain commands the production of a chemical substance named endorphin, which is a natural anti-stress chemical, which is launched In the blood stream. People show that someone's sense of humour is directly associated with the amount of endorphin which is produced by the organism, therefore, the bigger the production, the more well humoured a person becomes, and with a sense of wellness. This sundry of sounds produced stimulates the liberation of serotonin in the user, which is a neuron-transmitter involved in pleasure and relaxation sensations. With the driver calm, he will be more able to drive the vehicle more safely. The pedestrians will be subjected to smaller possibilities of mistakes, or imprudence of the drivers, thus, there will be less of a chance a pedestrian will be injured.

The drivers and passengers will preserve their health, therefore, and thereby preserve the health of drivers and passengers of adjacent vehicles.

Thus, when an individual uses the instrument of this invention, to follow a song of his/her preference, the benefits will be enormous and, when concentrating to follow its rhythm, and when participating therein, it becomes more possible to dive in a more intense manner into the song and therewith to release himself/herself and forget the surrounding difficulties, the accompaniment of the song will act as an expressive channel in which the pressures suffered and stress are discharged.

The most complex Traffic Laws will neither have as much success with so small of an investment as this method and apparatus nor attain such success in such little time. The driver will come home calm, and will tranquilly talk to the children, spouse or significant other, and neighbours without shouts, threats, headaches, etc. The same will take place when the driver arrives in his/her work. Therefore, it will help people to be happier and healthier.

The use of this invention is recommended to all individuals subjected to the damages of the stress, particularly inside automotive vehicles, because the method is in plain accordance with the current medical-psychological precepts. It is also intended for hyperactive persons, who, when practicing the rhythmic accompaniment method, discharge excess energy they have (in most cases these are young persons, banging in every place, etc.). It is also indicated as entertainment, sometimes a person who likes a song can practice the method/apparatus and spend a lot of busy time, with a pleasant task.

The method, as we have seen, is based on the simultaneous application of the song, rhythm and movement, which makes part of its fundamental principle, which, in conjunction with the apparatus, will achieve the goals of the system, which is the antistress effect. The method also is considered a vehicle for emotional self-expression. When practicing the method, the person stimulates several cerebral regions, areas responsible for emotion, memory and motor control. The functioning of the apparatus, the electronic transducer when excited, will emit a sound which can be of percussion, keyboard, horn or string instrument, therefore by following a song the person changes the song, varying in intensity and frequency, because the relevant apparatus is directed to the combat of stress, and it is not directed to musical perfection. The apparatus will be used in automotive vehicles to combat stress, or for a pleasant musical entertainment. It can also be used by persons with excess energy (young persons in general), to dissipate this excess energy and keep them in a good mood, or in other situations and occasions. When using the apparatus or method of the invention, by following with the electronic transducer or the sensor, with rhythmic standard, the song will not function in a passive manner as an anti-stress remedy, but will demand that the practitioner participate, generating a flow of musical anticipations. The practitioner more easily expresses his/her deepest desires, making them acceptable to the ego, because the practitioner can venture to draw sounds from his/her apparatus, in the most personal manner as possible. The practitioner, through rhythmic repetition, will be concentrated on following the rhythm of the song. To participate therein, it becomes possible for the practitioner to dive more intensely into the song, and therewith to release and forget the surrounding difficulties. The song rhythmic repetition will act as an expressive channel, in which the pressures suffered and stresses are discharged.

In automotive vehicles, the driver can be the only one to use and benefit from the method and apparatus of the present invention, but the apparatus can also be used by a passenger, thus forming a pleasant and unforgettable partnership.

Whereas an example of a preferred embodiment has been described, it shall be understood that the scope of this invention encompasses other possible variations, being limited only by the content of the appended claims, therein included are possible equivalents.

What is claimed is:

1. An electronic transducer for use in of a rhythmic apparatus comprising:

a flexible board;

a vibration sensor attached to a first inner portion of said flexible board; and a touch button fixed in a second outer portion of the flexible board.

2. An electronic transducer according to claim 1, comprising electronic circuitry associated to the second outer portion of the flexible board.

3. An electronic transducer according to claim 1, wherein said vibration sensor is formed of piezoelectric material.

4. An electronic transducer according to claim 2, wherein the electronic circuit comprises means for converting vibratory pulses into an electrical signal.

5. An electronic transducer according to claim 4, comprising a radio frequency transmitter for transmitting the electrical signal.

6. An electronic transducer according to claim 1, comprising fixating means comprising ties with adhesive portions.

7. An electronic transducer according to claim 5, wherein it is hold to a user's body by means of the ties with adhesive portions.

* * * * *